US010260794B2

(12) United States Patent
Cunningham

(10) Patent No.: US 10,260,794 B2
(45) Date of Patent: Apr. 16, 2019

(54) REFRIGERATOR SUPPORT APPARATUS AND METHOD

(71) Applicant: Danby Products Limited, Guelph (CA)

(72) Inventor: Bryan Stuart Cunningham, Kitchener (CA)

(73) Assignee: DANDBY PRODUCTS LIMITED, Guelph (CA)

( * ) Notice: Subject to any disclaimer, the term of this patent is extended or adjusted under 35 U.S.C. 154(b) by 0 days.

(21) Appl. No.: 15/496,587

(22) Filed: Apr. 25, 2017

(65) Prior Publication Data

US 2017/0336129 A1 Nov. 23, 2017

Related U.S. Application Data

(60) Provisional application No. 62/338,048, filed on May 18, 2016.

(51) Int. Cl.

| | |
|---|---|
| ***F25D 19/00*** | (2006.01) |
| ***A47B 88/90*** | (2017.01) |
| ***A47B 87/02*** | (2006.01) |
| ***A47B 91/00*** | (2006.01) |

(52) U.S. Cl.

CPC ..... *F25D 19/00* (2013.01); *A47B 87/0276* (2013.01); *A47B 88/941* (2017.01); *A47B 91/005* (2013.01); *A47B 2088/902* (2017.01); *F25D 2323/0011* (2013.01)

(58) Field of Classification Search

CPC ... F25D 19/00; A47B 88/941; A47B 87/0276; A47B 91/005

USPC ..... 312/257.1, 401, 330.1, 351.1, 351.2, 312/334.1, 334.7; 248/678, 346.01

See application file for complete search history.

(56) References Cited

U.S. PATENT DOCUMENTS

| | | | | | |
|---|---|---|---|---|---|
| 1,756,984 | A * | 5/1930 | Mason | F25D 11/00 | 312/107 |
| 3,410,441 | A * | 11/1968 | Rhyne | A47B 88/941 | 220/4.28 |
| 4,120,551 | A * | 10/1978 | Godtschalck | A47B 88/941 | 312/348.1 |
| 5,823,650 | A * | 10/1998 | Lin | A47B 88/941 | 312/348.1 |
| 6,193,340 | B1 * | 2/2001 | Schenker | A47B 47/0075 | 312/108 |
| 6,585,225 | B1 * | 7/2003 | Lake | A47B 47/0075 | 206/320 |
| 7,281,775 | B2 * | 10/2007 | Yang | A47B 91/005 | 312/334.7 |
| 7,748,682 | B2 * | 7/2010 | Hunke | D06F 39/12 | 248/346.05 |
| 2004/0245899 | A1 * | 12/2004 | Cho | A47B 91/005 | 312/351.2 |

(Continued)

*Primary Examiner* — James O Hansen

(74) *Attorney, Agent, or Firm* — Ralph E. Jocke; Walker & Jocke

(57) ABSTRACT

An exemplary support structure for a refrigerator (12) includes a pedestal (10). The pedestal is comprised of a housing (18) comprised of a plurality of panels (20, 22, 24, 26, 28) which are held together in fixed relation through interengaging projections and recesses. A drawer (32) is comprised of a plurality of drawer panels (34, 36, 38, 40, 44) which are held together through interengaging projections and recesses. The panels which make up the pedestal are configured along with other components to be packed and shipped in a single box (30).

24 Claims, 29 Drawing Sheets

(56) References Cited

U.S. PATENT DOCUMENTS

| | | | | |
|---|---|---|---|---|
| 2004/0263032 | A1* | 12/2004 | Cho | A47B 67/04<br>312/330.1 |
| 2005/0241344 | A1* | 11/2005 | Graute | D06F 39/12<br>68/3 R |
| 2007/0151120 | A1* | 7/2007 | Tomasi | D06F 29/00<br>34/601 |
| 2007/0249212 | A1* | 10/2007 | Buecker | D06F 39/005<br>439/369 |
| 2013/0106271 | A1* | 5/2013 | Anderson | A47B 88/0466<br>312/334.9 |

* cited by examiner

REFRIGERATOR SUPPORT APPARATUS AND METHOD

TECHNICAL FIELD

Exemplary embodiments relate to an apparatus and method for providing support to a household appliance such as a refrigerator. Exemplary embodiments include a pedestal that can be used to support a refrigerator and which provides storage for holding items. Exemplary embodiments also provide a support structure that can be readily packaged, shipped and assembled.

BACKGROUND

Household appliances are commonly found in homes, dormitories, hotels, offices and other places. Common household appliances include refrigerators and freezers for maintaining food items or other items at temperatures below room temperatures. For purposes of this disclosure, a refrigerator will also be deemed to include a freezer or similar device.

Refrigerators are generally built to be supported on a floor surface. As a result, items that are stored at the bottom of the refrigerator are sometimes difficult to reach. This may be particularly true for persons with disabilities or that may be confined to wheelchairs or the like.

Also, there is usually a need for storage of other items near a refrigerator. This may include, for example, plates, glasses, napkins or utensils that are often used to consume the food that is removed from the refrigerator. There is also sometimes a need to store food products that do not require refrigeration.

Existing refrigerators and related structures may benefit from improvements.

SUMMARY

Exemplary embodiments include an apparatus that is usable to support a refrigerator thereon. Exemplary embodiments include a pedestal that is used to support a refrigerator a sufficient distance above the floor so that items stored in a lower portion of the refrigerator are more readily accessible.

Exemplary embodiments include a pedestal that securely supports a refrigerator thereon and reduces the risk that the refrigerator may move relative to the pedestal. Further exemplary embodiments include an interior storage area within the pedestal that is usable for storing items that a user may wish to have adjacent to their refrigerator.

Exemplary embodiments include a pedestal structure that can be packed and shipped in a single box. Exemplary embodiments include a pedestal that can be assembled readily by persons with limited mechanical skills and with few or no hand tools. Numerous alternative arrangements and embodiments are also discussed.

DETAILED DESCRIPTION

Figure 1:
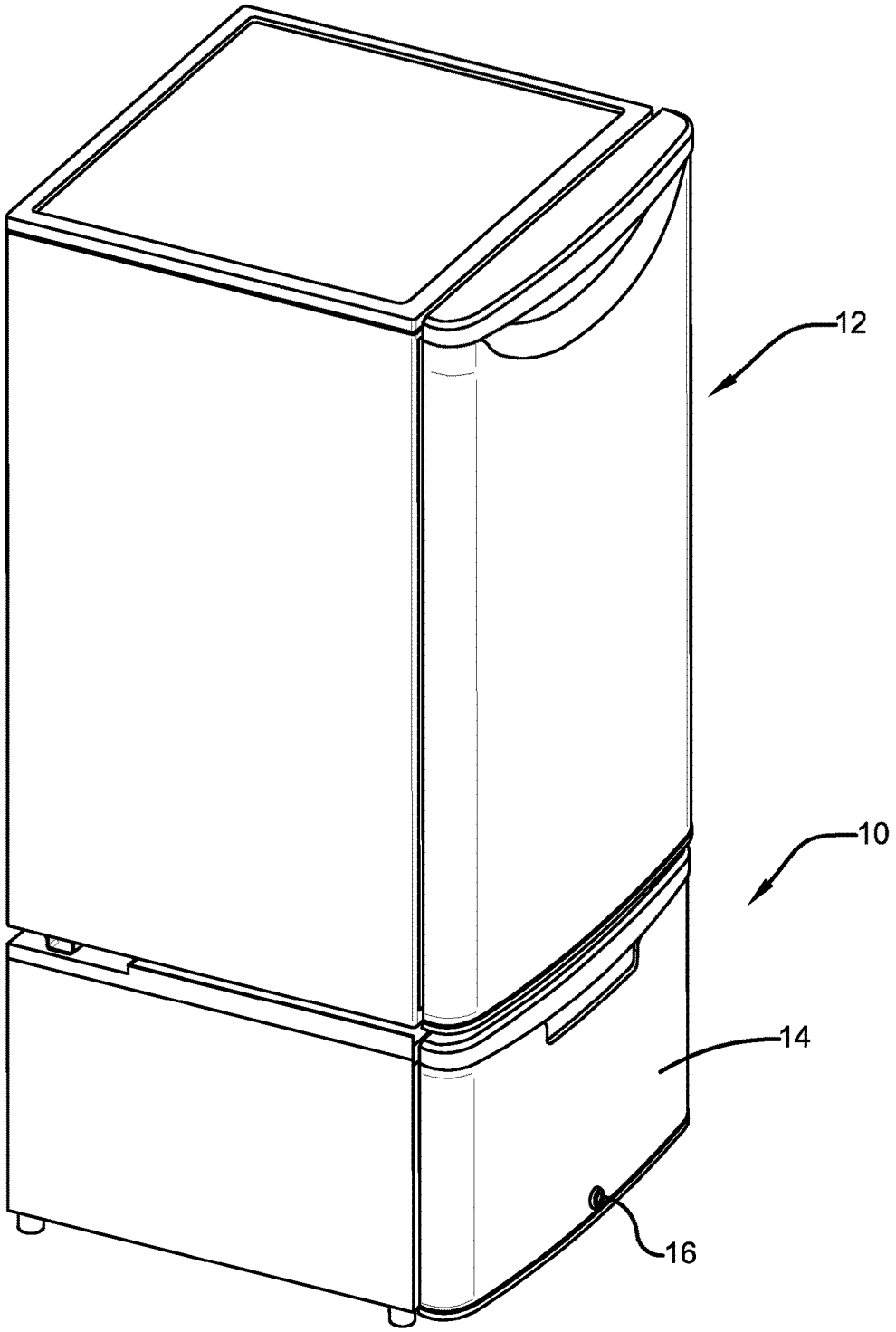
FIG. 1 is a right top front isometric view of a refrigerator and exemplary pedestal support structure in engaged relation.

Referring now to the drawings and particularly to FIG. 1, there is shown therein a refrigerator support apparatus which is alternatively referred to herein as a pedestal 10 in supporting connection with a refrigerator 12. In the exemplary arrangement, the width and length of the pedestal 10 corresponds closely to the width and length of the refrigerator. However, it should be understood that this approach is exemplary and in other embodiments other configurations may be used. Further in the exemplary arrangement, the pedestal 10 includes a door 14. The door 14 is openable to access an interior area of the pedestal as later explained. The exemplary door 14 is held in a closed position by a latch 16.

Figure 3:
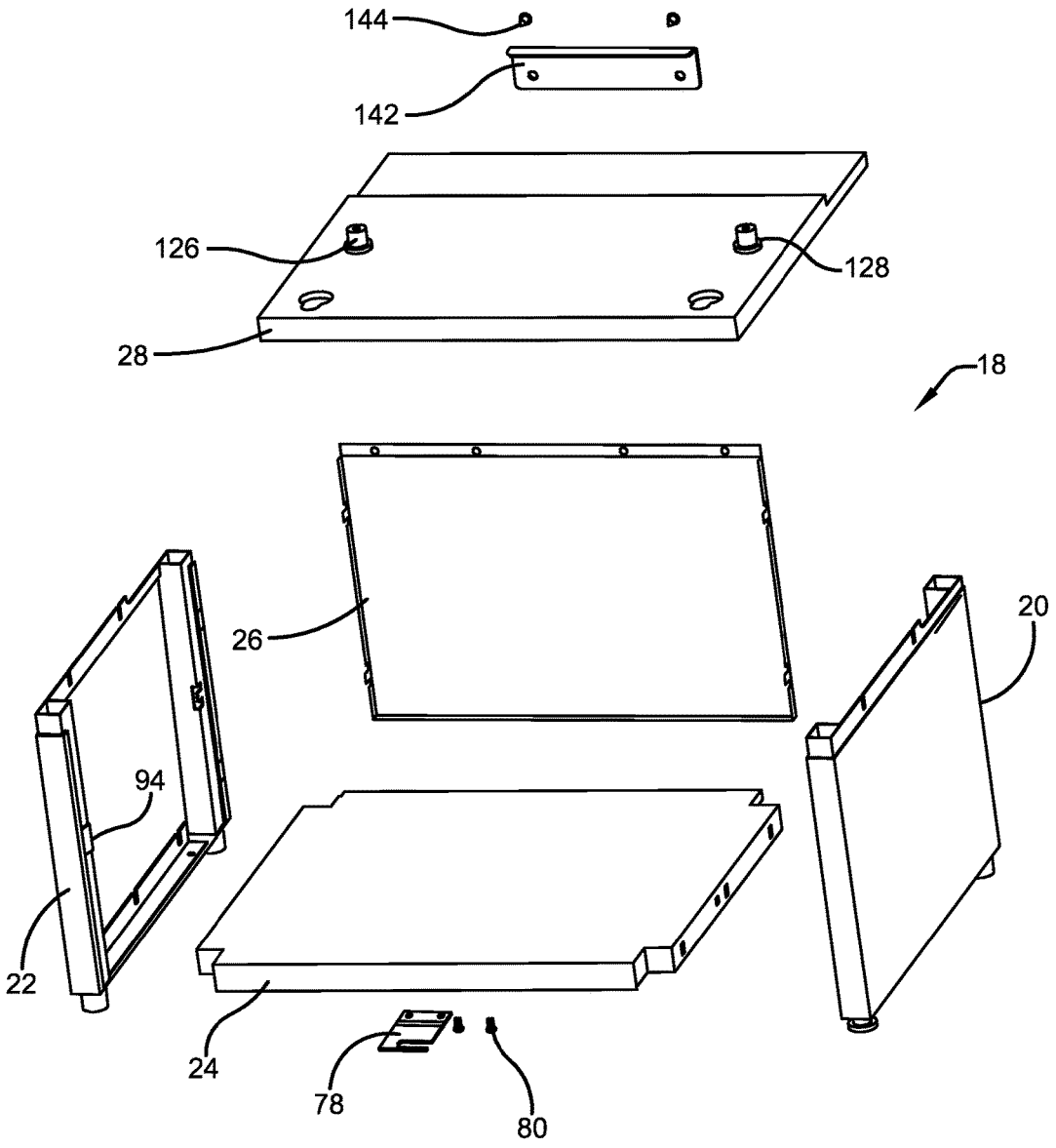
FIG. 3 is an exploded isometric view of a housing structure of an exemplary embodiment.
Figure 10:
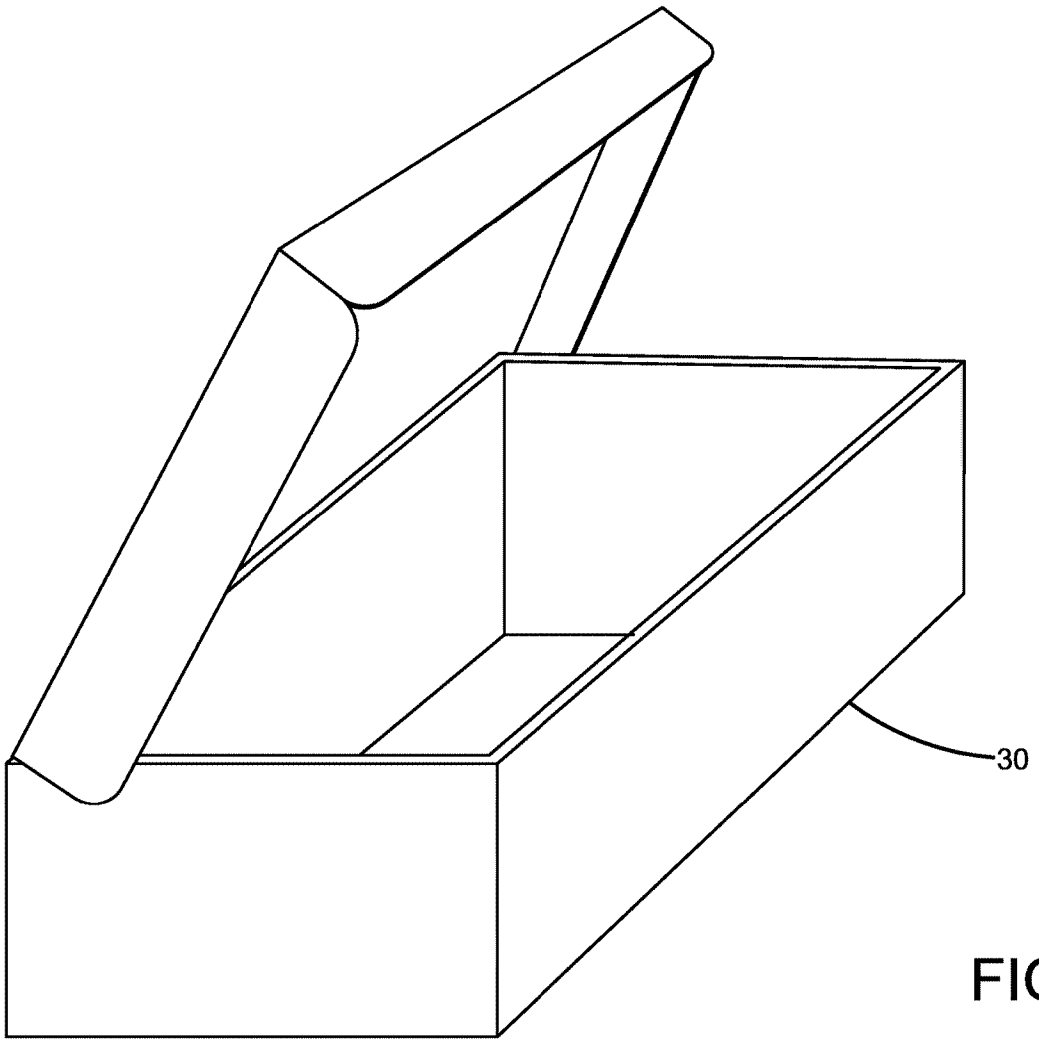
FIG. 10 is an isometric view of a box used for holding and shipping the components which make up an exemplary pedestal embodiment.
Figure 11:
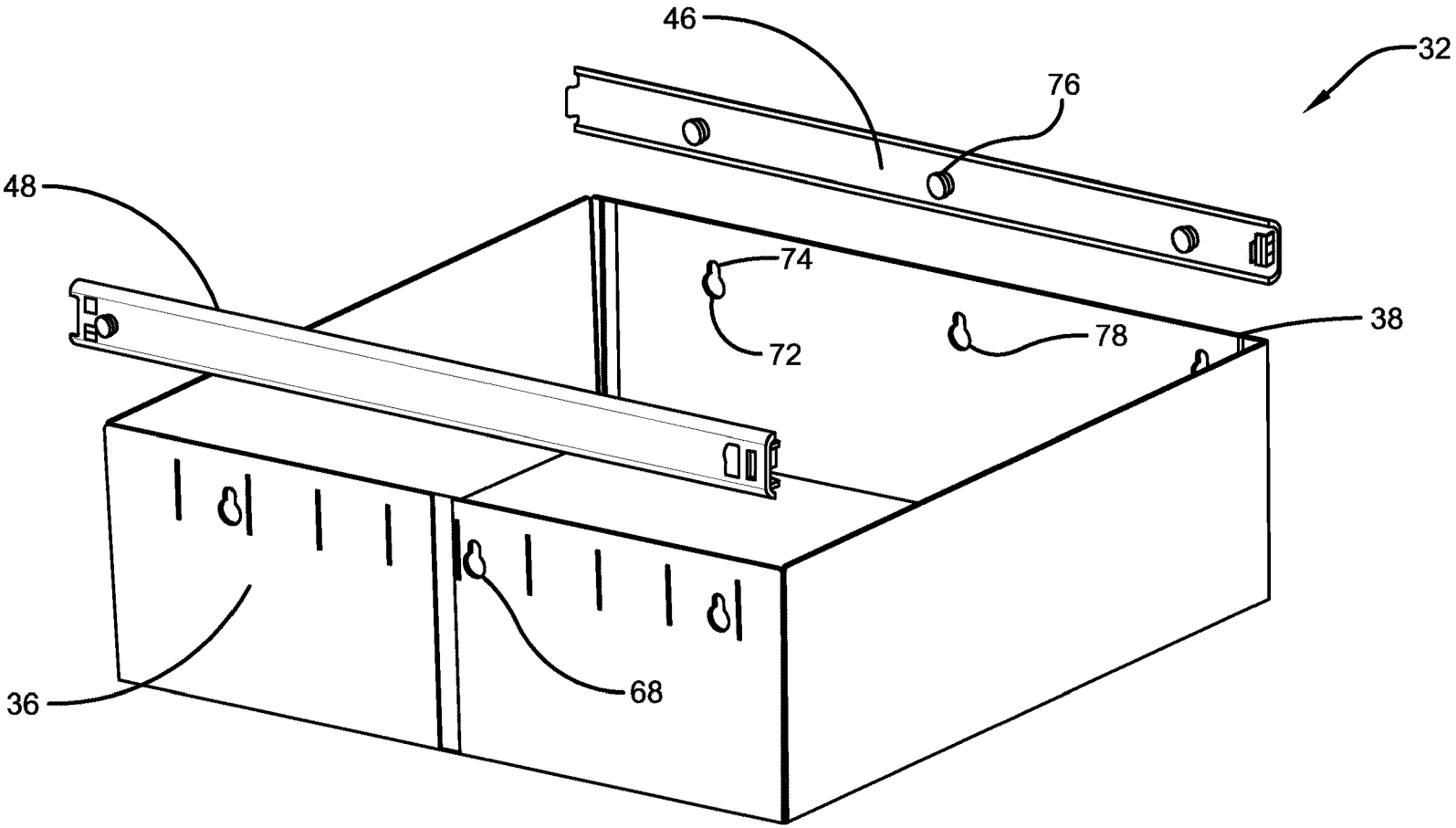
FIG. 11 is an exploded isometric view of a drawer structure and drawer slides.

In an exemplary arrangement, the pedestal is comprised of a plurality of wall panels which are shown in FIG. 3. The plurality of wall panels are assembled to form a housing 18 of the pedestal. The exemplary housing 18 includes a first side wall panel 20 and a second side wall panel 22. A bottom panel 14 extends between the side wall panels when the housing is assembled in a manner that is later discussed. A back wall panel 26 extends between the side wall panels and is engaged therewith in a manner that is later discussed. A top panel 28 overlies the other panels and is engaged therewith in an assembled condition of the housing. In an exemplary arrangement, the plurality of panels which make up the housing of the pedestal are enabled to be held in fixed relation through interengaging projections and recesses. The exemplary interengaging projections and recesses as later described, enable the housing panels to be held together without the use of additional fasteners. Further in an exemplary embodiment, the housing panels prior to assembly to form the housing, are enabled to be packed in flat parallel relation for purposes of storage and shipment in a single box such as box 30 shown in FIG. 10.

Figure 2:
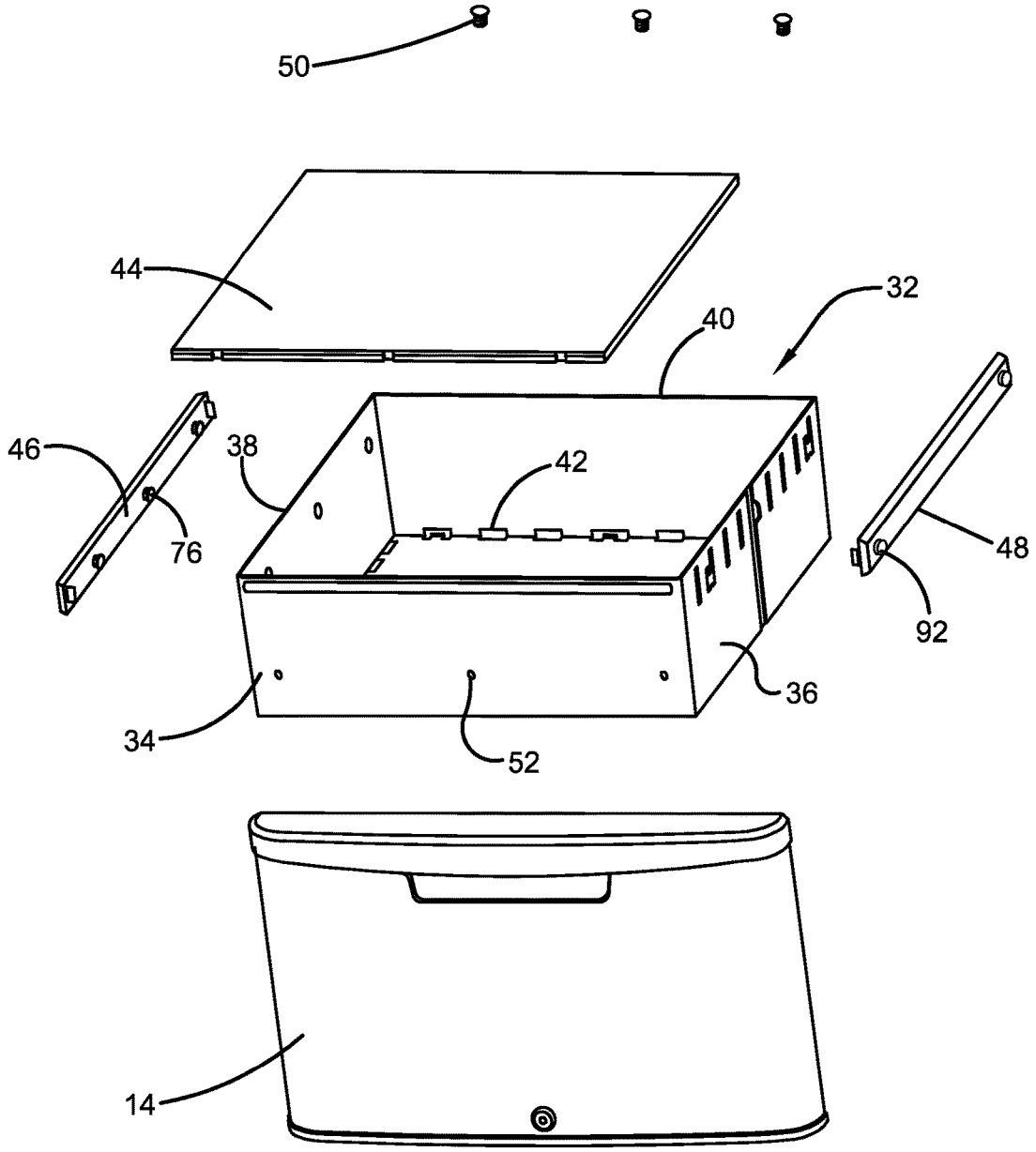
FIG. 2 is an exploded isometric view of a drawer structure of an exemplary embodiment.

Further in the exemplary embodiment the door 14 is attached to a drawer 32. As shown in FIG. 2, the drawer 32 is comprised of a plurality of drawer panels. In exemplary embodiments the drawer panels are held together in fixed relation by interengaging projections and recesses without the use of separate fasteners. In the exemplary arrangement, the drawer 32 includes a drawer front panel 34. The drawer also includes a drawer first side panel 36 and a drawer second side panel 38. The drawer further includes a drawer back panel 40.

In the exemplary arrangement, the drawer front, back and side panels include a plurality of inwardly disposed upward extending tabs 42. The tabs 42 include recesses that are engageable with projections on a drawer bottom panel 44. The drawer is engageable in a manner later discussed with slides 46 and 48. In the exemplary arrangement, the door is held to the drawer front panel 34 by screws 50 which extend through holes 52 in the drawer front panel.

Figure 4:
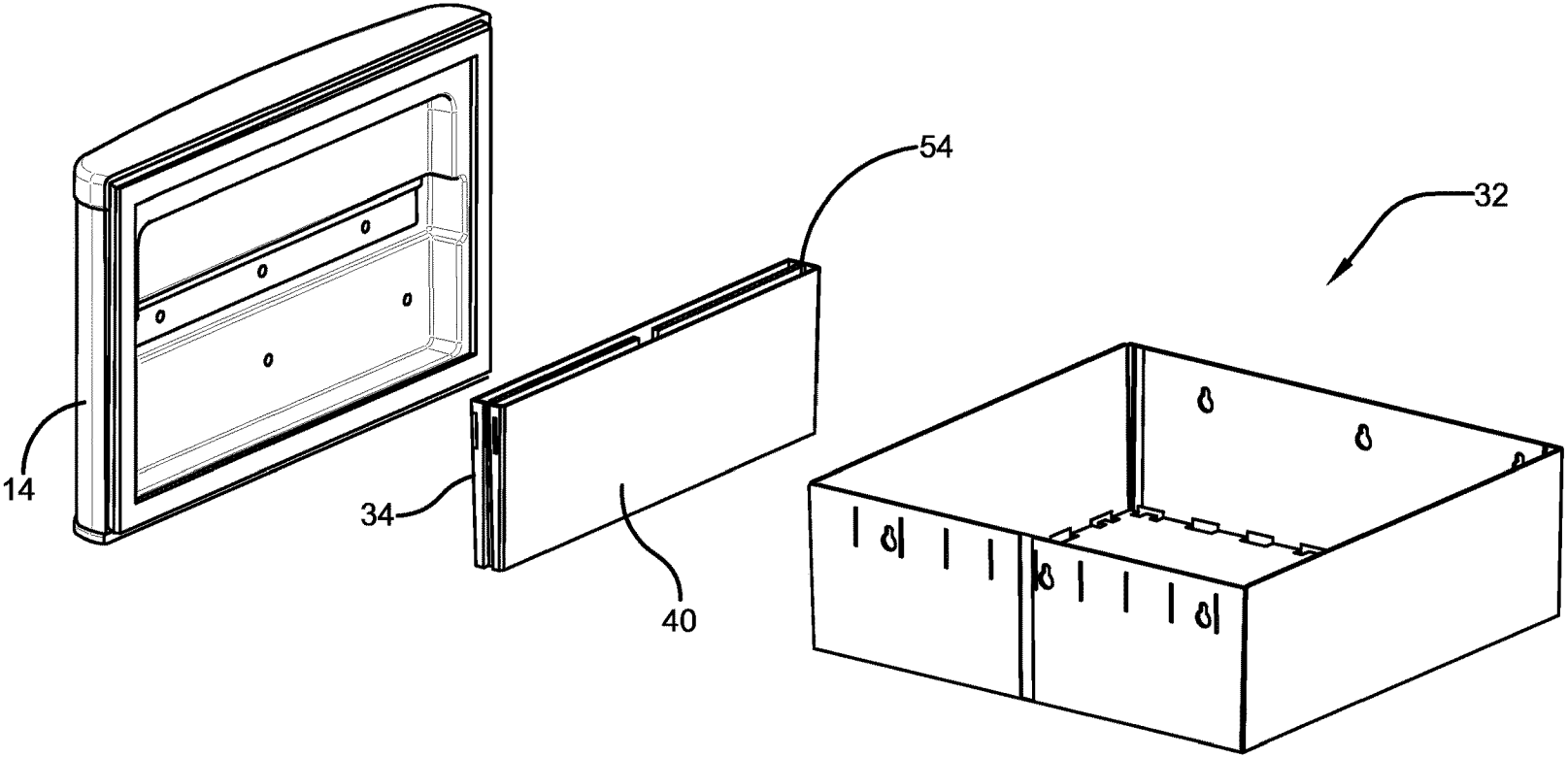
FIG. 4 is an exploded view of the drawer and door structure of an exemplary embodiment.
Figure 5:
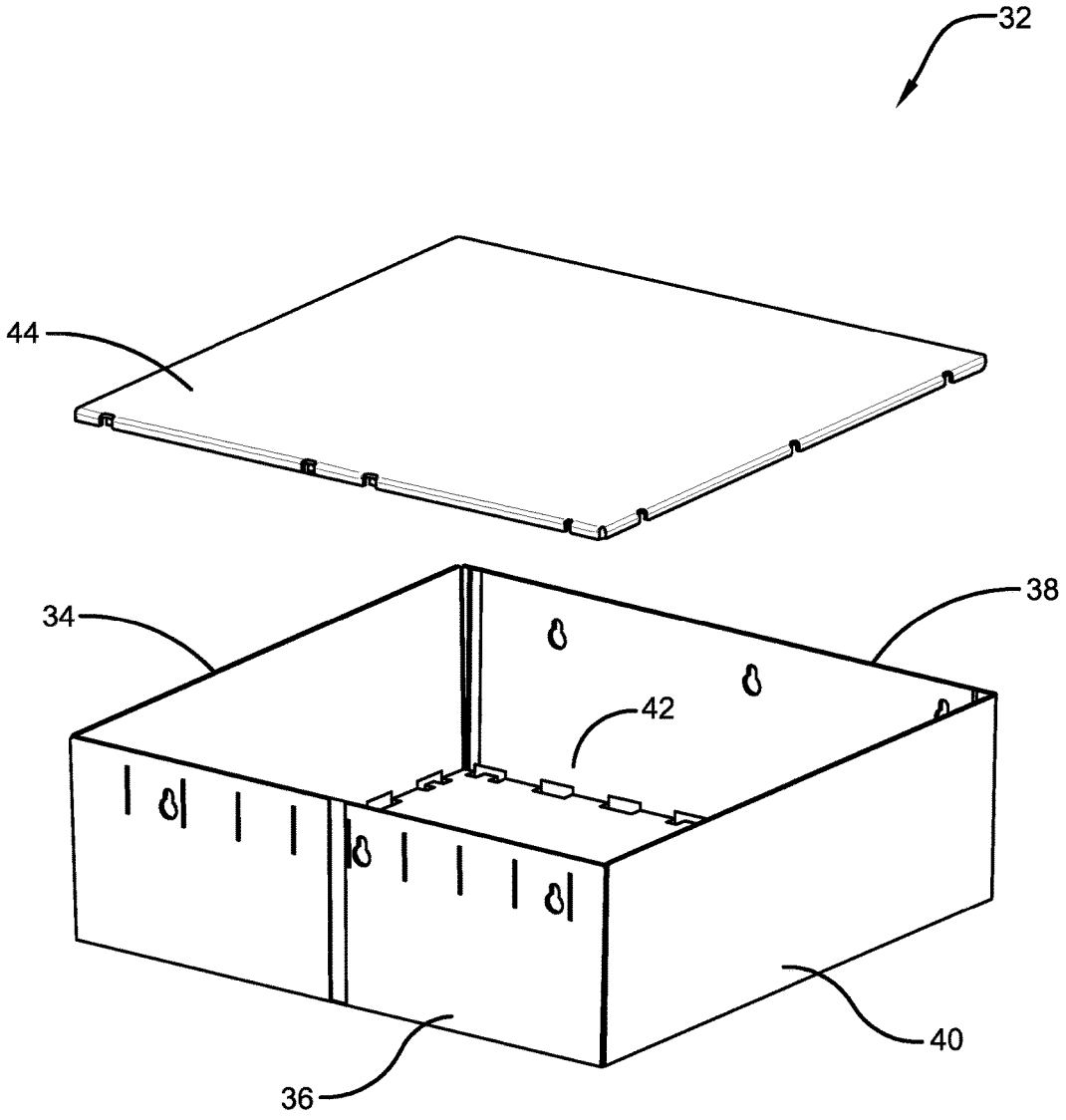
FIG. 5 is an exploded view of a drawer structure and drawer bottom panel being installed therein.
Figure 6:
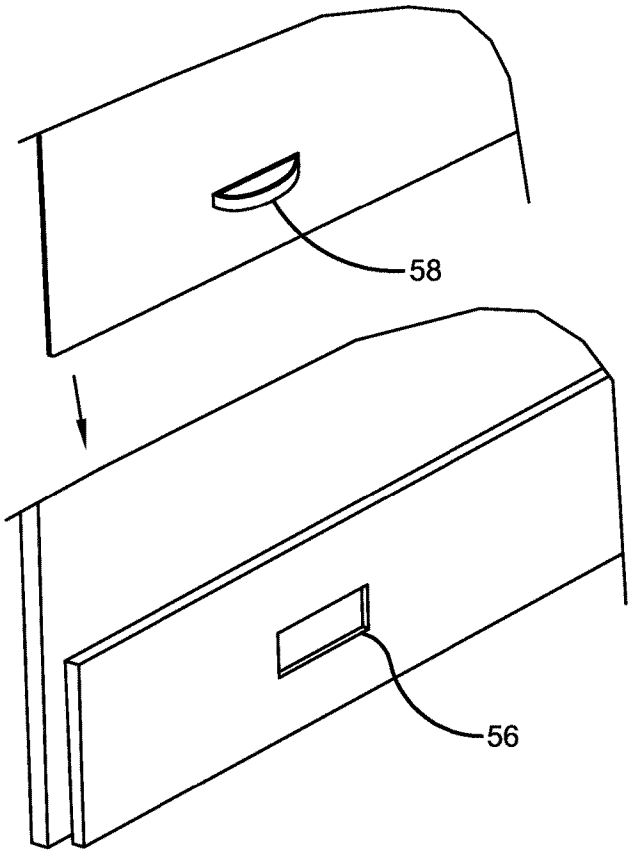
FIGS. 6 and 7 are exemplary embodiments of an interengaging projection and recess structure used to hold components together in an exemplary embodiment.
Figure 7:
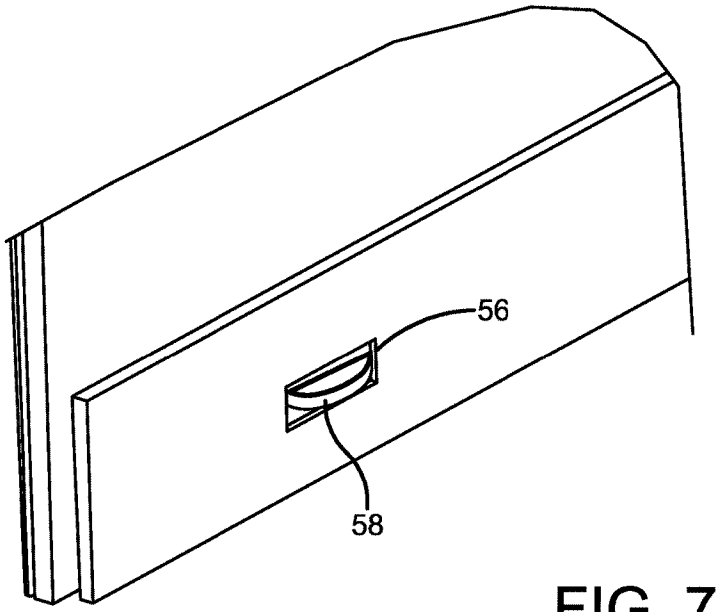

In the exemplary embodiment the drawer panels and the door, similar to the housing panels, are configured to be packed in flat parallel relation in the single box 30 which enables the exemplary pedestal to have the components thereof shipped in the single box. In addition in the exemplary arrangement, components which make up the pedestal in addition to the drawer and wall panels may also be housed and shipped within the single box. For example as shown in FIG. 4, the front, back and side panels which make up the drawer 32 can be packed very closely as represented by the stack 54 of such panels. As represented in FIG. 5, the drawer 32 is formed by engaging projections and recesses on respective panels so as to form the drawer structure. Such interengaging projections and recesses in an exemplary arrangement are of the type shown in FIGS. 6 and 7, and 8 and 9. As previously mentioned, the front, back and side drawer panels each include in turned tabs 42 at the lower portion thereof. When the wall panels are assembled, the drawer bottom panel 44 is moved downwardly or otherwise perpendicular to the wall panels, within the opening defined by the drawer. The recesses in the tabs such as the opening 56 shown in FIG. 6 is configured to accept a projection 58 in engaged relation therein. Thus moving the projection downward as shown in FIG. 6 causes the projection 58 to be engaged in the recess 56 which is operative to hold the adjacent panel structures together. In exemplary arrangements, such interengaging projections on the bottom panel 44 recesses engage the tabs 42 as the bottom panel is pressed downwardly as shown. This holds the drawer panels in operatively fixed engagement therewith without the need for tools or separate fasteners.

Figure 8:
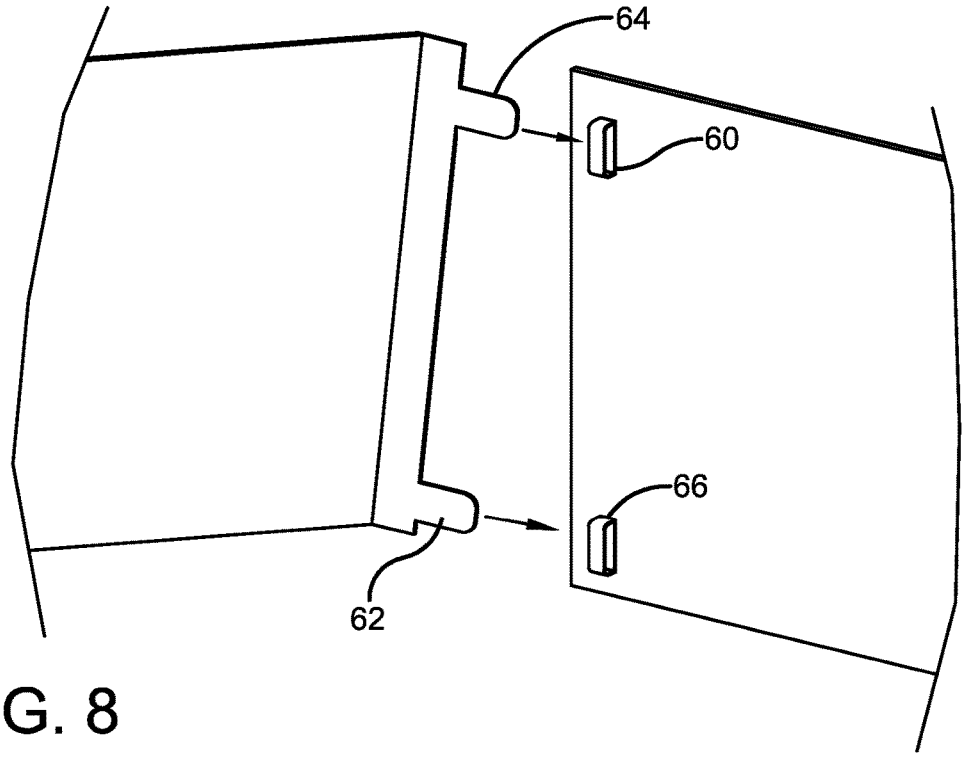
FIGS. 8 and 9 are views of an alternative interengaging projection and recess structure used in exemplary embodiments.
Figure 9:
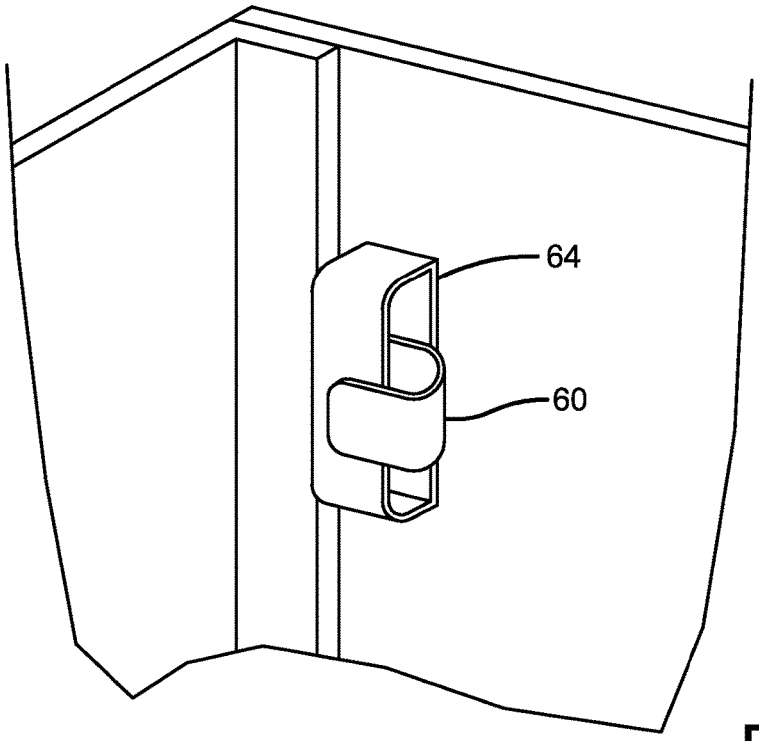

Other components of the drawer and other structures of the exemplary pedestal include interengaging projections and recesses like those shown in FIGS. 8 and 9. In exemplary arrangements, projections 60, 62 in connection with one panel or other structure are extended through a recess in a form of a corresponding slot 64, 66. In some exemplary arrangements once the projection has been engaged with the recess, the projection may be deformed in a manner like that represented in FIG. 9 to further secure such engagement. Of course it should be understood that these approaches are exemplary and in other embodiments, other approaches may be used.

In the exemplary embodiment of the drawer 32, the drawer side panels 36 and 38 include key slots 68 and 70 therein. In the exemplary embodiment, the key slots each include an enlarged circular key slot end 72 and a narrowed key slot end 74. In the exemplary arrangement, the narrowed key slot ends extend in an upward direction as shown relative to the enlarged key slot ends.

Figure 12:
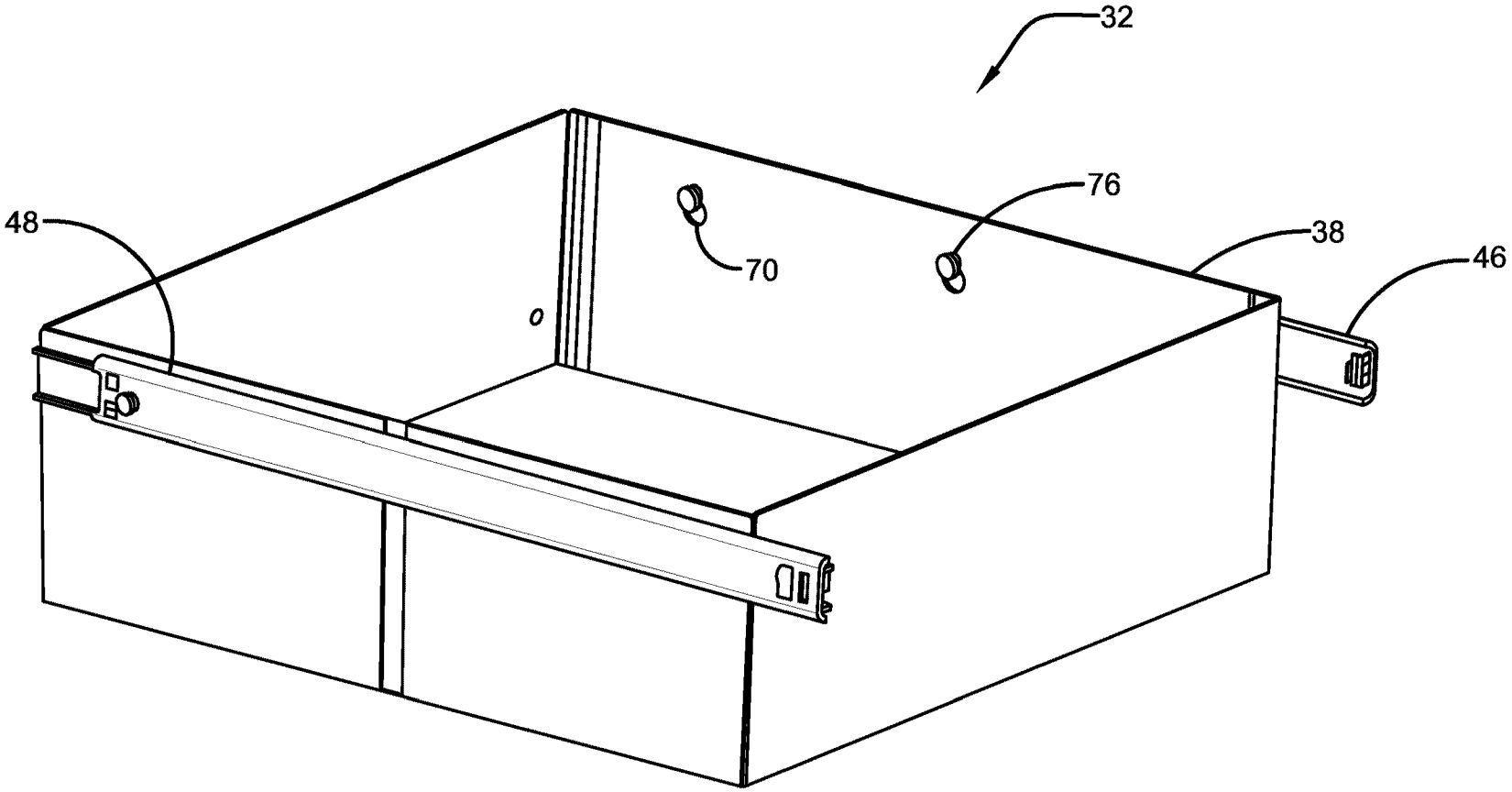
FIG. 12 is a view similar to FIG. 10 with the slides in attached relation with the drawer.

The slides 46 and 48 each include pins 76 extending on a first side thereof. The pins 76 are positioned to extend on the side of the slide that is adjacent to a drawer side panel. In the exemplary embodiment, each pin includes an enlarged head portion at the end of the pin disposed furthest away from the slide, and a narrower shaft portion of the pin that extends between the slide and the head. In the exemplary arrangement, the key slots are configured such that the enlarged head portion of each pin can extend through the enlarged key slot end to the inward side of the respective drawer panel side wall as shown in FIG. 12. After the pins are extended through the side wall, the drawer and pin can be relatively moved such that the shaft portion of the pin extends in the narrowed key slot end. In this condition as represented in FIG. 12, the enlarged head of each pin holds the adjacent slide and drawer side panel in engaged relation. As can be appreciated, this approach enables engaging the drawer 32 and the slides in engaged relation without the use of or the requirement for separate fasteners.

Figure 13:
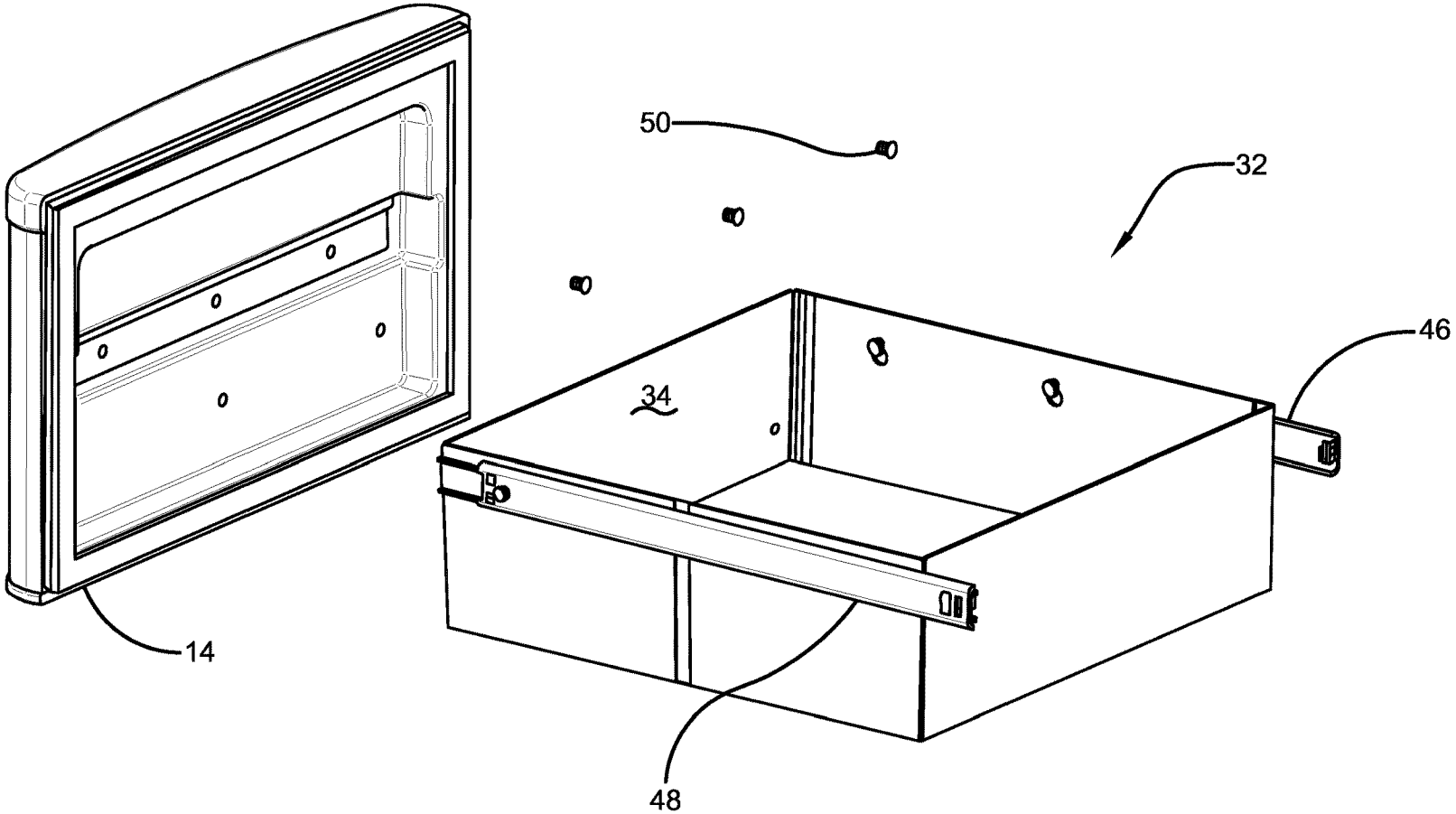
FIG. 13 is an isometric view of the drawer and slide structure and a door which is attached thereto.
Figure 14:
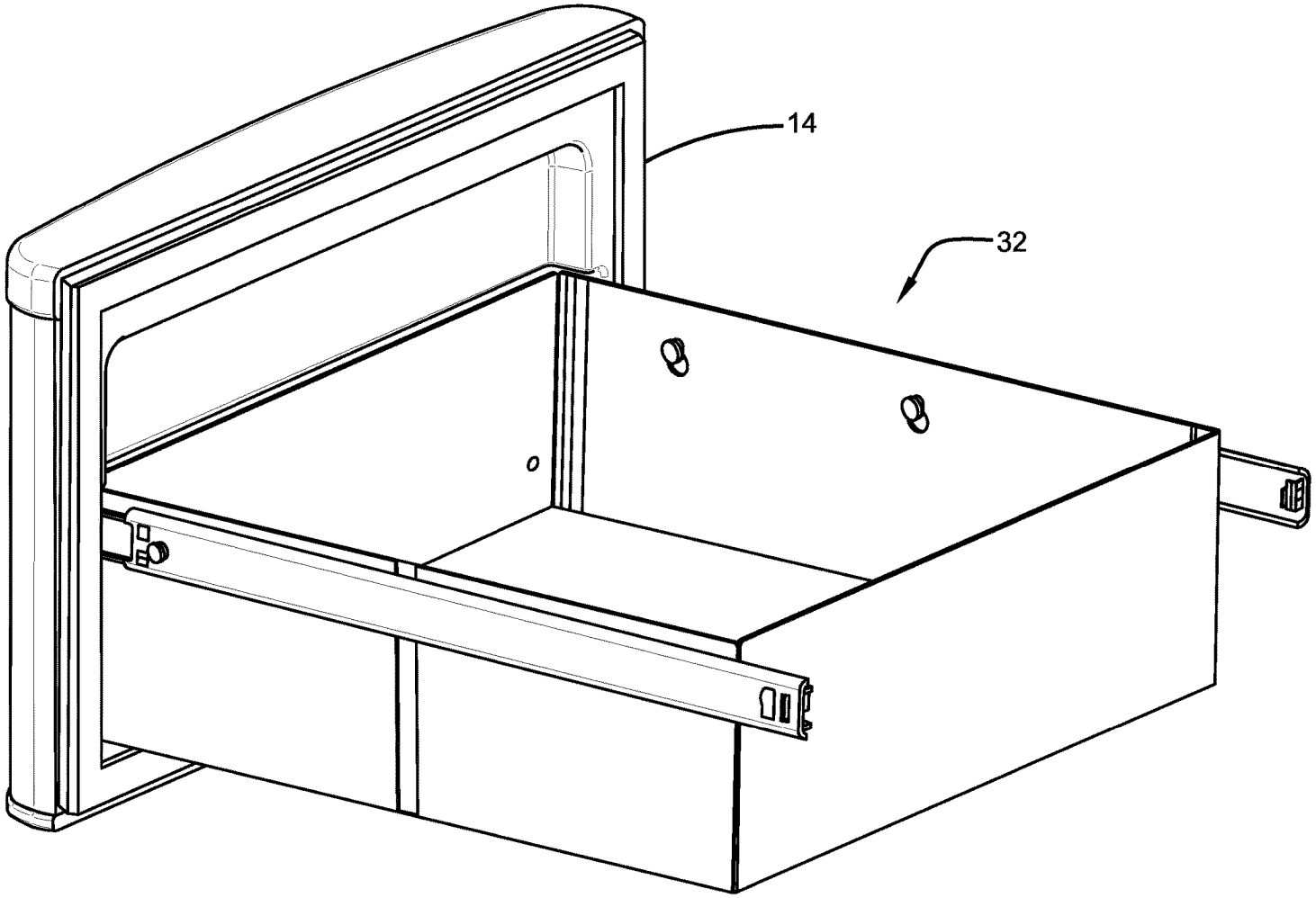
FIG. 14 is an isometric view of the drawer and door structure in engaged relation.

As represented in FIG. 13, with the drawer and slides in engaged relation, the door 14 may be attached to the drawer front wall 34 through the use of screws 50. It should be understood, however, that although in the exemplary arrangement separate fasteners in the form of screws are used for this purposes, in other arrangements other types of fasteners including interengaging projections and recesses may be used. FIG. 14 shows the exemplary drawer held in engaged relation with the door 14. FIG. 14 represents the assembled drawer and door construction of the exemplary pedestal embodiment. It should be understood that although only a single drawer structure is used in this embodiment, in other embodiments multiple drawer structures or alternative shelf or other support structures may be used.

Figure 15:
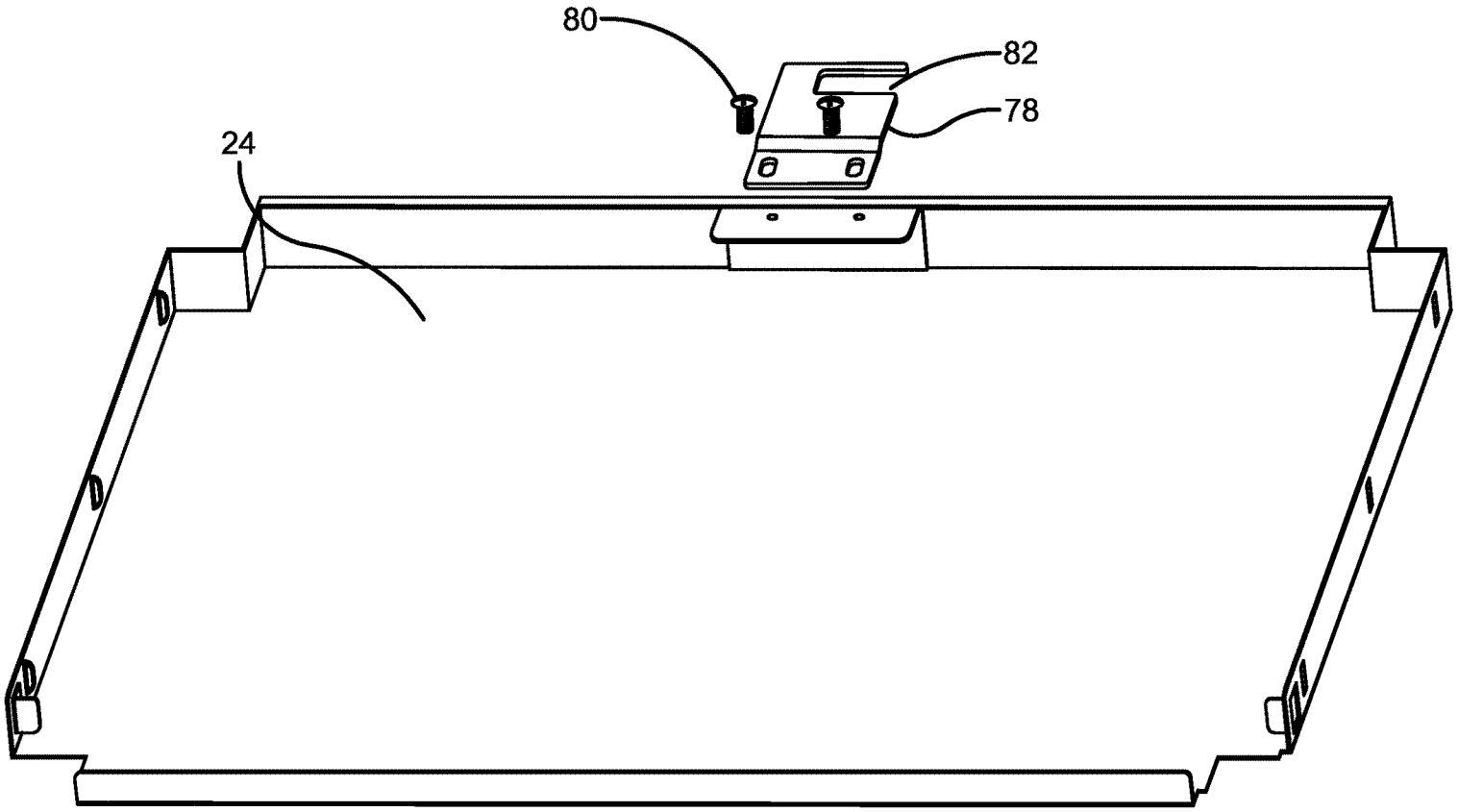
FIG. 15 is an isometric view of a bottom housing panel and a strike engaged therewith.
Figure 16:
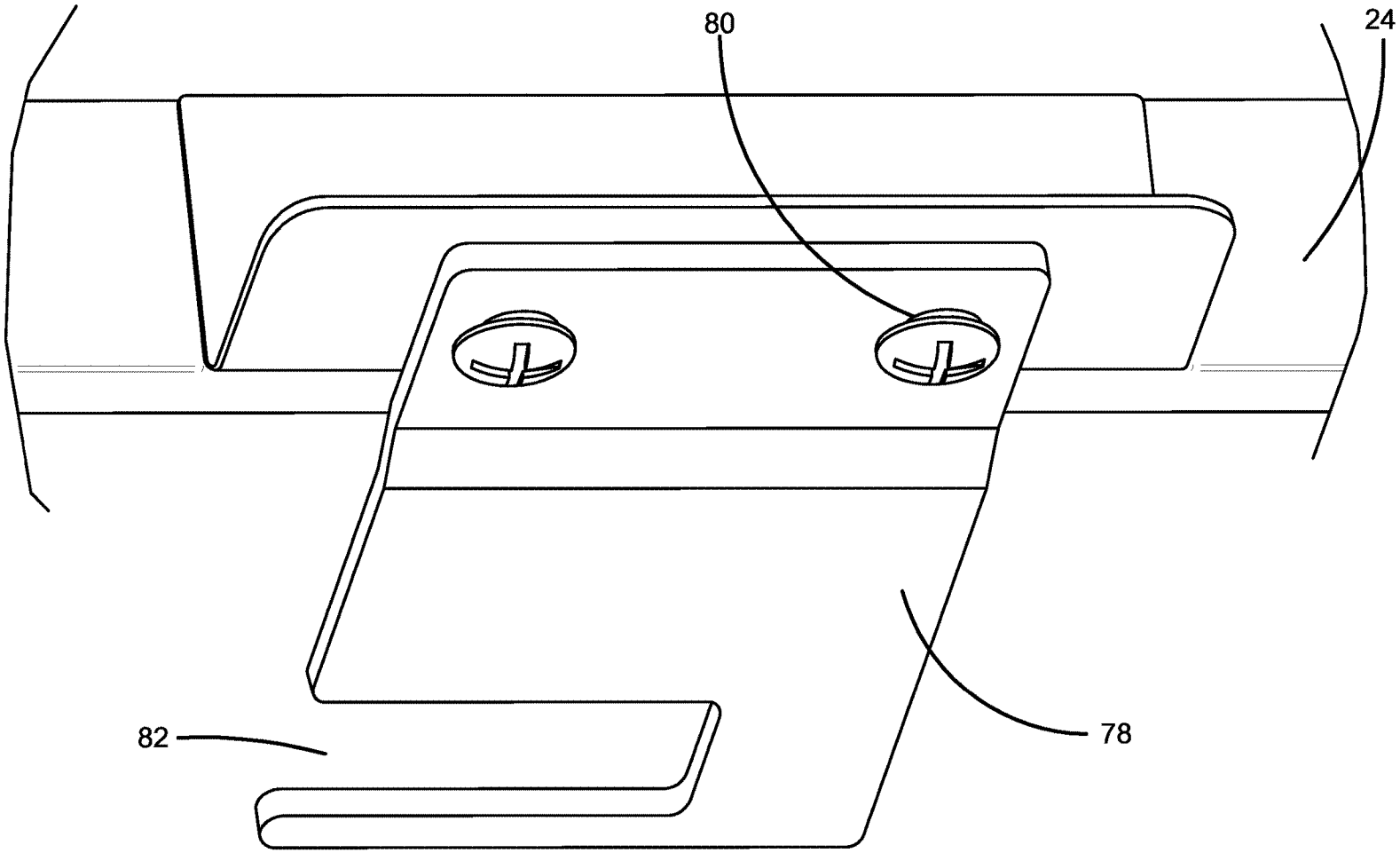
FIG. 16 is an enlarged isometric view of the strike.

FIG. 15 shows a bottom view of the bottom panel 24. Bottom panel 24 includes walls with projections and recesses that can be utilized for purposes of holding the bottom panel in engagement with the side wall panels and the back panels. Further in the exemplary arrangement, a strike 78 is engaged with the bottom panel 24 through fasteners 80. In the exemplary arrangement shown in FIG. 16, the strike 78 includes a strike opening 82 for purposes of engaging the bolt of a latch as later discussed.

Figure 17:
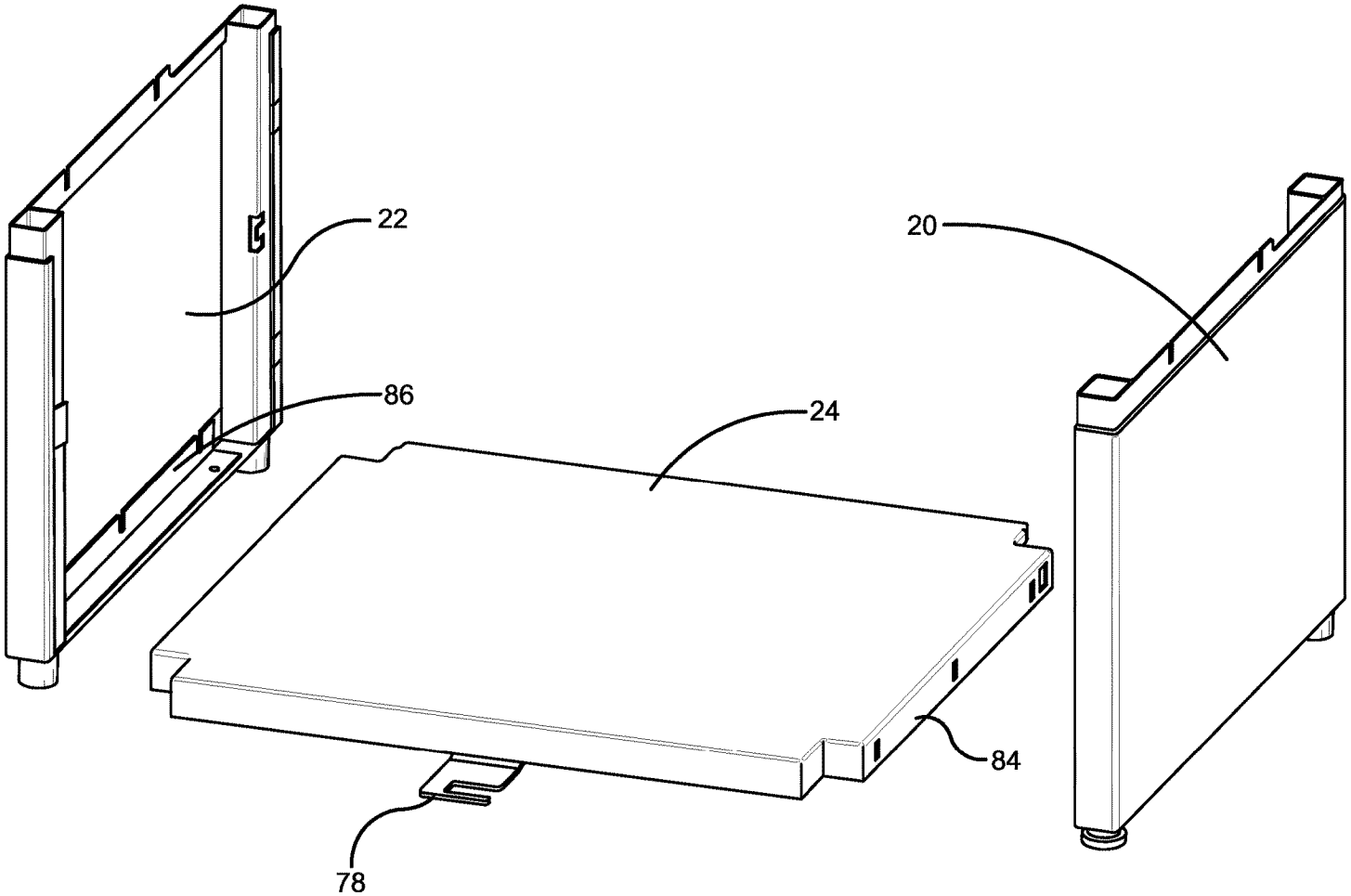
FIG. 17 is an isometric exploded view of first and second side wall panels and a bottom panel of a housing.
Figure 18:
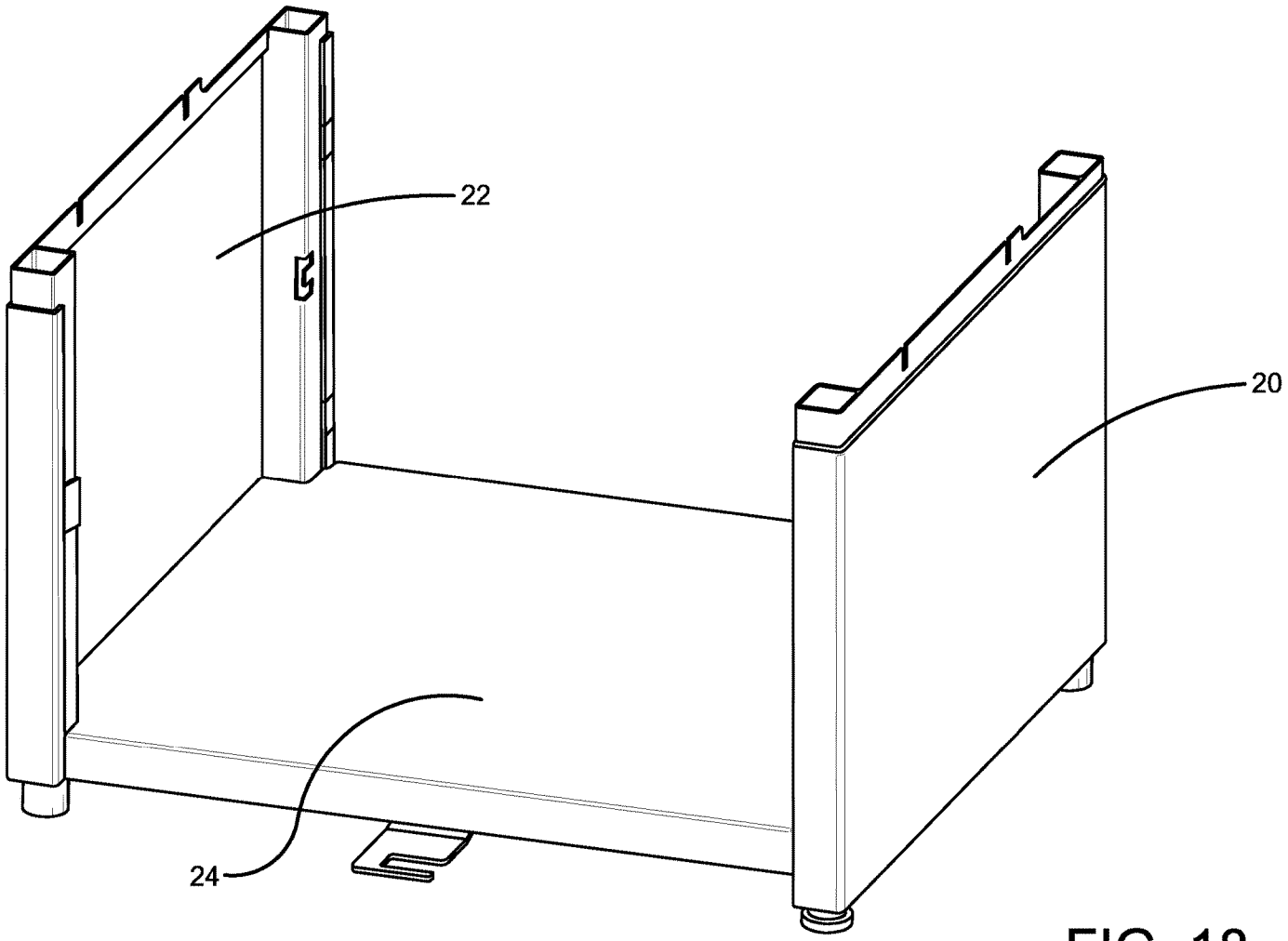
FIG. 18 is an isometric view of the first and second side wall panels and the bottom panel of an exemplary housing in engaged relation.
Figure 19:
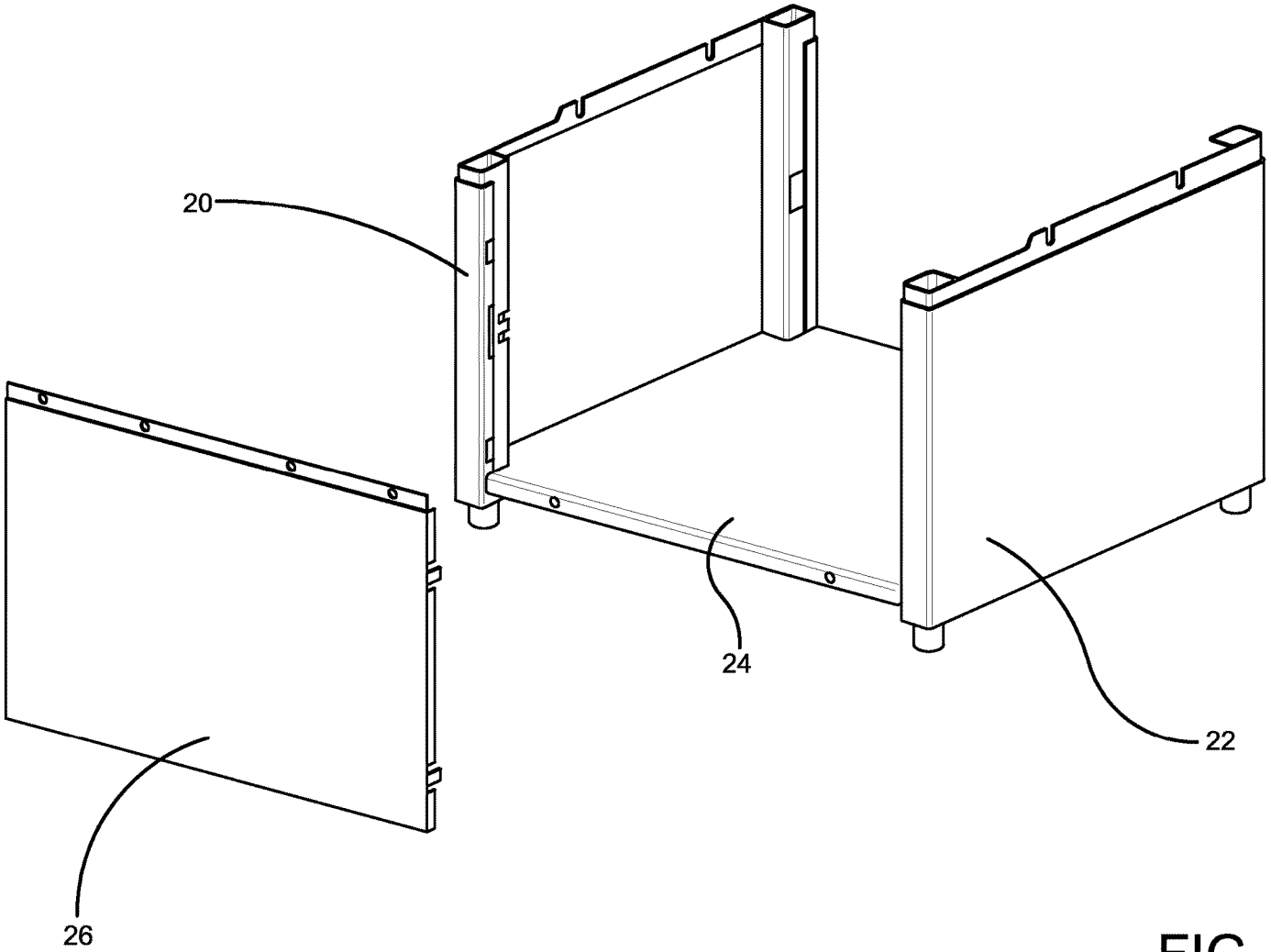
FIG. 19 is an exploded back view of the side wall panels, bottom panel and back wall panel of the exemplary housing.

FIGS. 17 and 18 show the side wall panels 20 and 22 of the housing and the bottom panel 24 being engaged. In the exemplary arrangement, extending sides 84 of the bottom panel include interengaging projections and recesses which engage inner walls 86 of the side wall panels. In the exemplary arrangement, the interengaging projections and recesses on the extending sides 84 and inner walls 86 engage in a manner similar to that described in connection with FIGS. 6 and 7 when the extending sides are moved in intermediate relation between the respective side wall panel and the inner wall 86 thereof. Downward movement of the bottom panel 24 as shown relative to side panels is operative to cause the engagement of the bottom panel and side panels so as to produce the housing subassembly shown in FIG. 18. As shown in FIG. 19, the back wall panel 26 is engaged to the bottom and side wall panels 20, 22 and 24.

Figure 20:
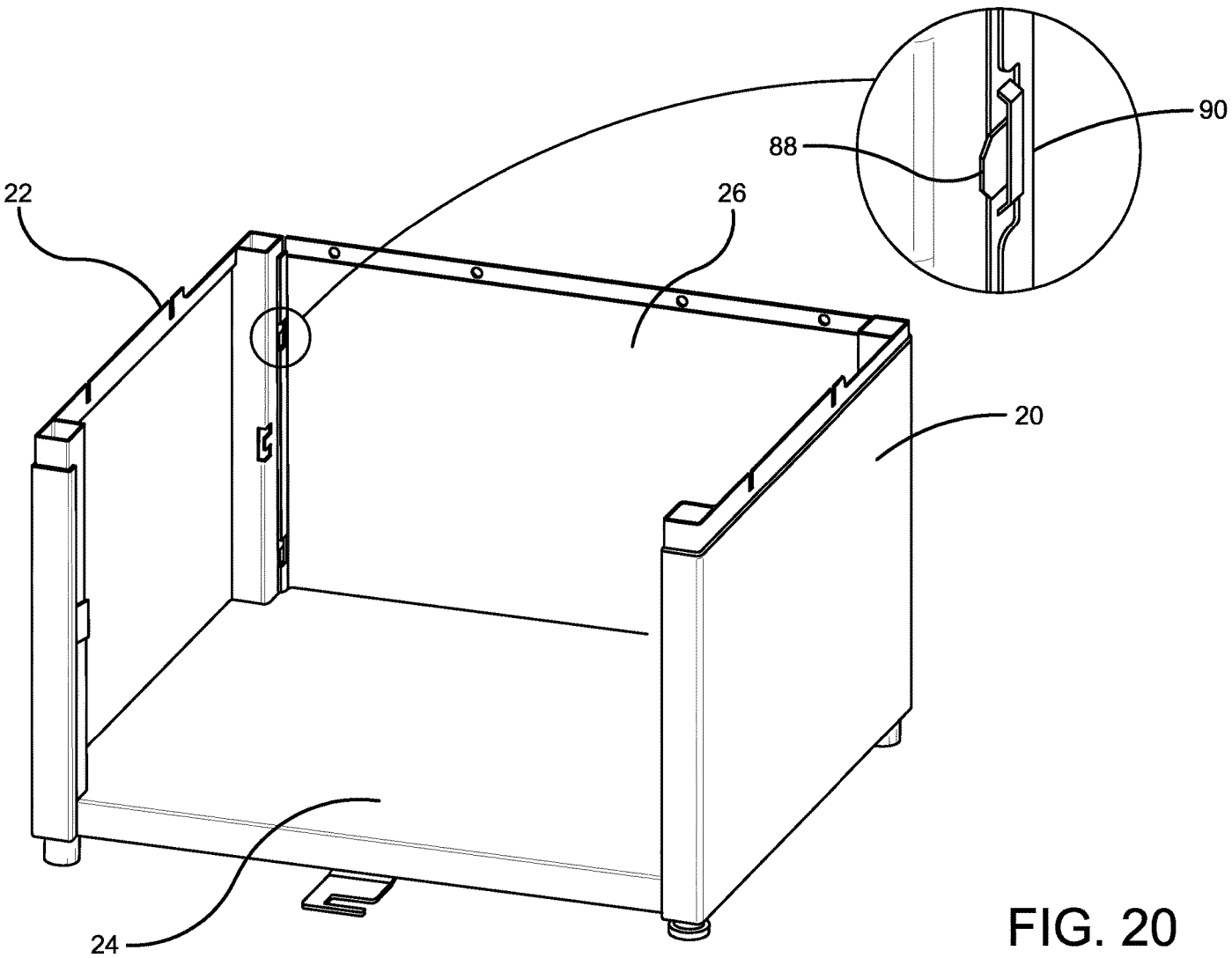
FIG. 20 is a front isometric view of the side wall panels, bottom panel and back panel of the exemplary housing in engaged relation, with an enlarged view of an interengaging projection and recess used to hold the back panel in engaged relation with the other panels of the housing.
Figure 21:
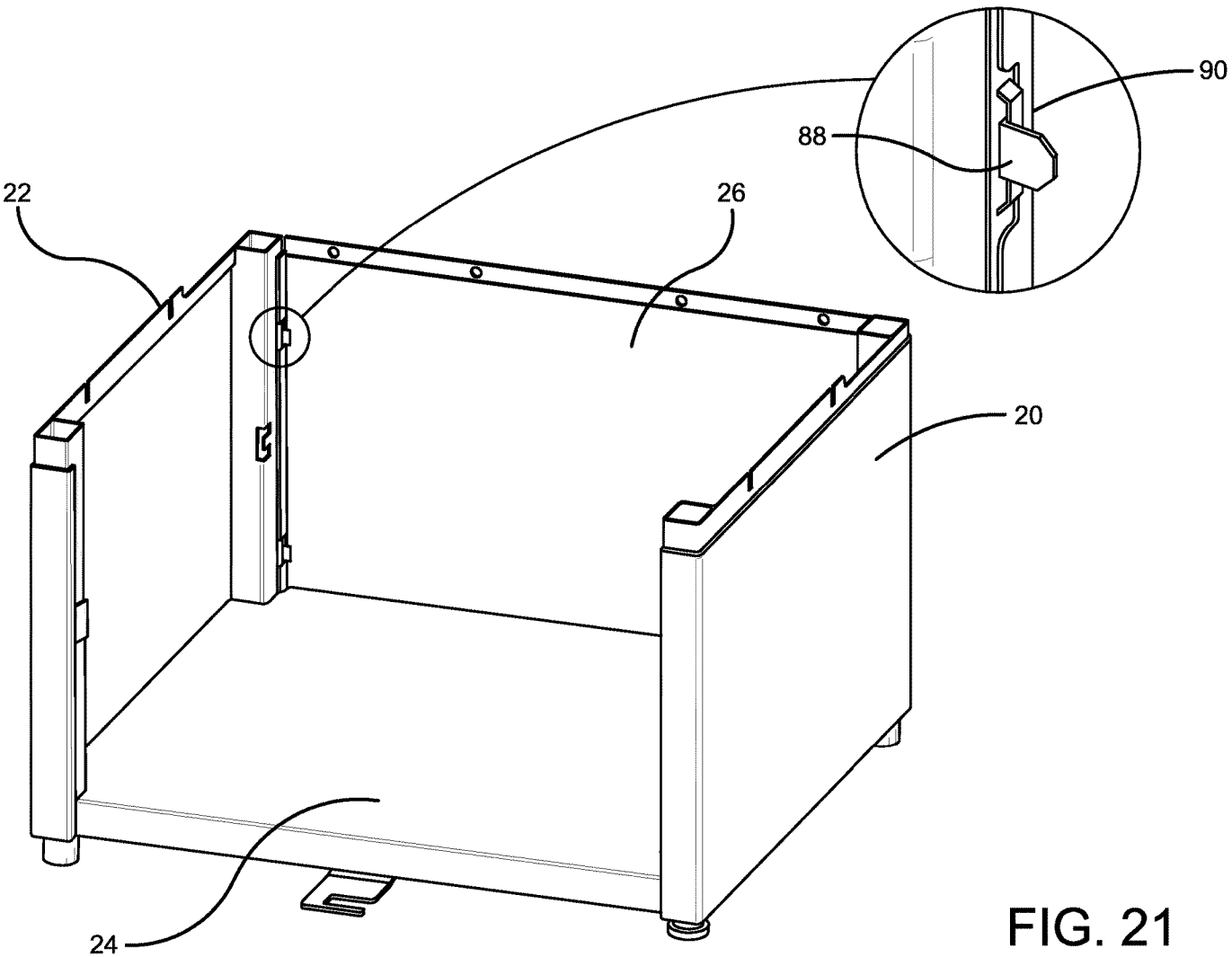
FIG. 21 is a view similar to FIG. 20 showing the interengaging projection and recess configured to hold the panels in engaged relation.

As shown in the enlarged section of FIG. 20, the back wall panel 26 and side wall panels 20 and 22 include interengaging projections 88 and recesses 90. In the exemplary arrangement as represented in FIG. 21, with the projections 88 engaged with the recesses 90, the projections may be bent or otherwise turned so as to further secure the projections and recesses in fixed engaged relation. Of course it should be understood that these approaches are exemplary and in other embodiments, other approaches may be used.

Figure 22:
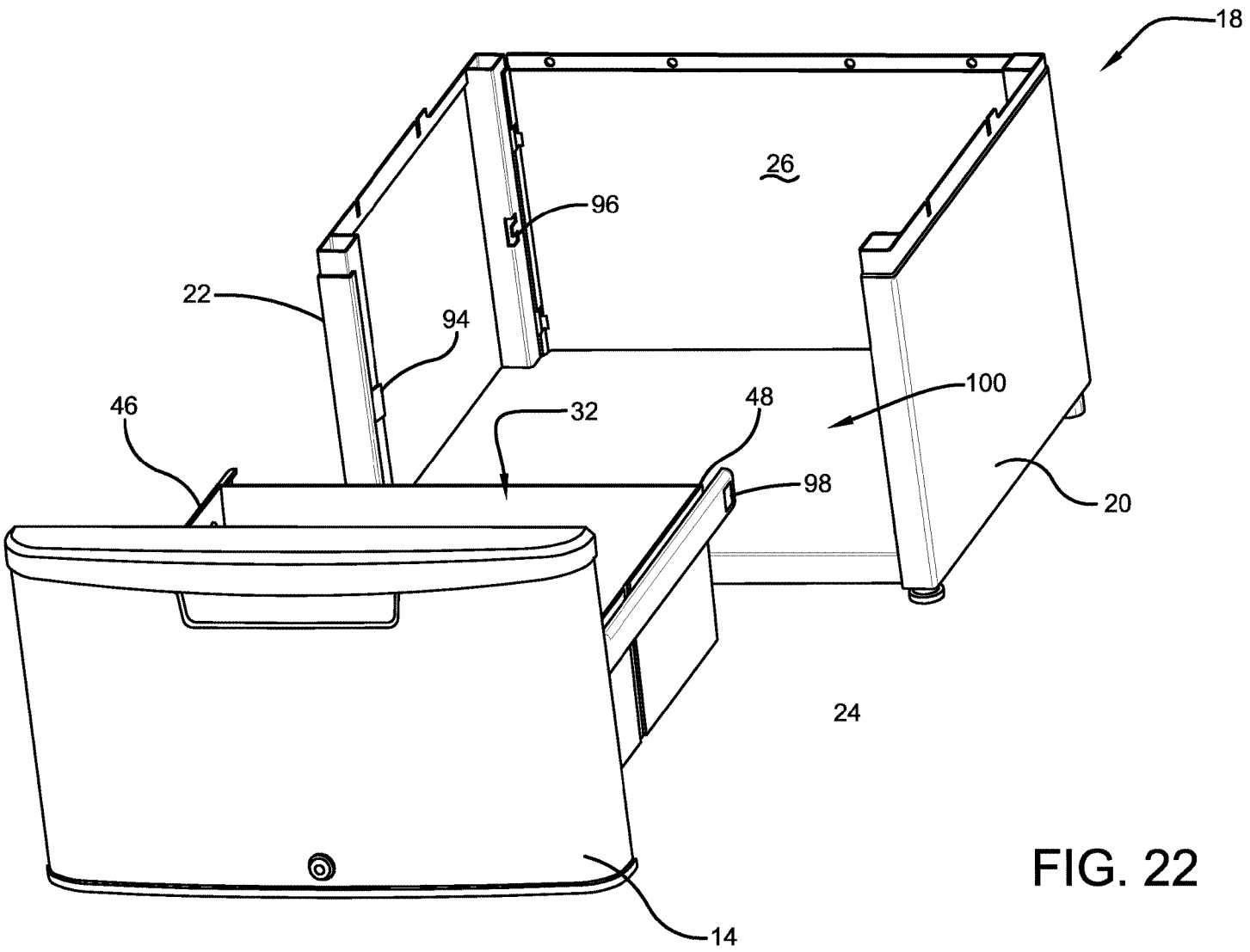
FIG. 22 is an exploded isometric view of the housing and drawer structures prior to engagement of the drawer and the housing.
Figure 23:
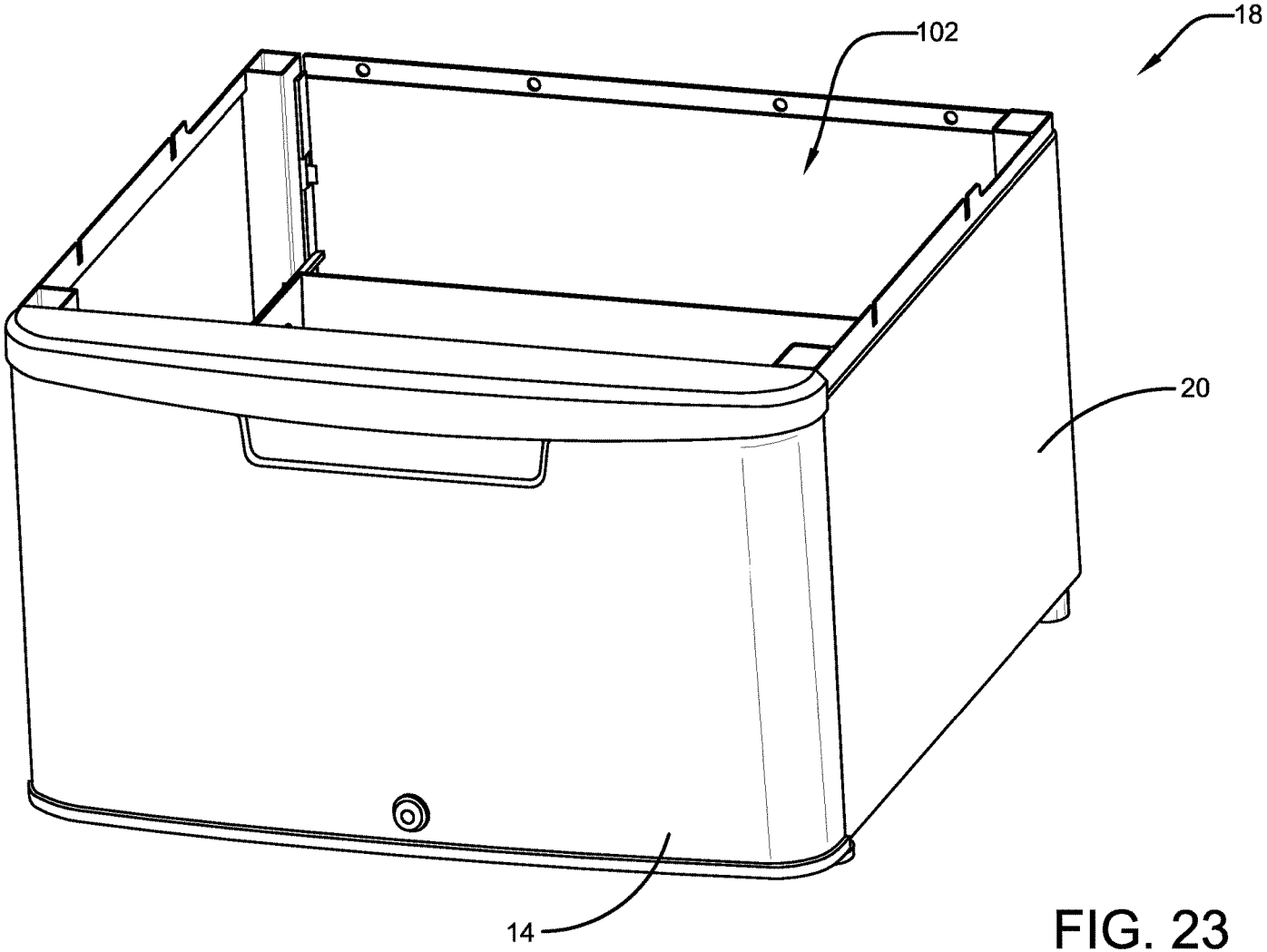
FIG. 23 is an isometric view showing the drawer and door in engagement with the housing.

FIG. 22 shows the drawer and door assembly in adjacent relation with the partially assembled housing 18 of FIG. 21. In the exemplary arrangement, the slides 46 and 48 include further pins 92 (see FIG. 2). Pins 92 extend on a side of the slides opposite the side from which the pins 76 extend. The further pins 92 are configured to engage in recesses 94 that extend in housing side wall panels 20 and 22. Further in the exemplary embodiment, each of the side wall panels 20 and 22 include projections 96. Projections 96 are configured to engage in recesses 98 at an opposed end of each respective slide from the further pins.

In the exemplary arrangement, the door and drawer assembly is movable into the open side 100 of the housing that extends opposite back wall panel 26. The projections 96 on the side wall panels are engaged with the recesses 98 on the slides and the further pins 92 are engaged with the recesses 94 in the side wall panels. Such engagement operates to hold the slides in operatively fixed engagement with the side walls 20 and 22. Thus the drawer 32 is enabled to be positioned within an interior area 102 of the housing 18, in which position the door 14 covers the open side 100 of the housing. Of course as can be appreciated, the exemplary door and drawer is enabled to be extended outwardly from the housing in supported connection with the slides. Of course this approach is exemplary and in other embodiments, other approaches may be used.

Figure 24:
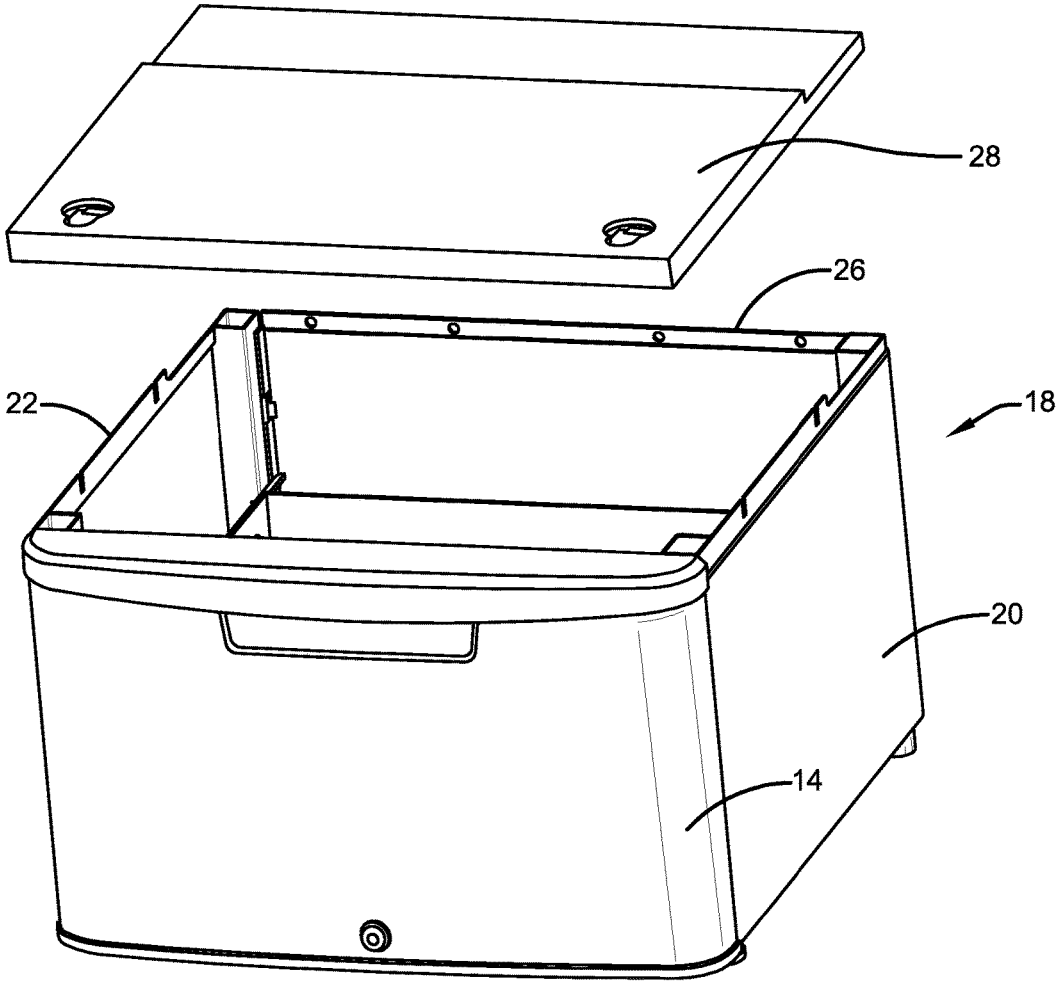
FIG. 24 is an exploded view showing the assembled housing panels and drawer and door structures along with the housing top panel.
Figure 25:
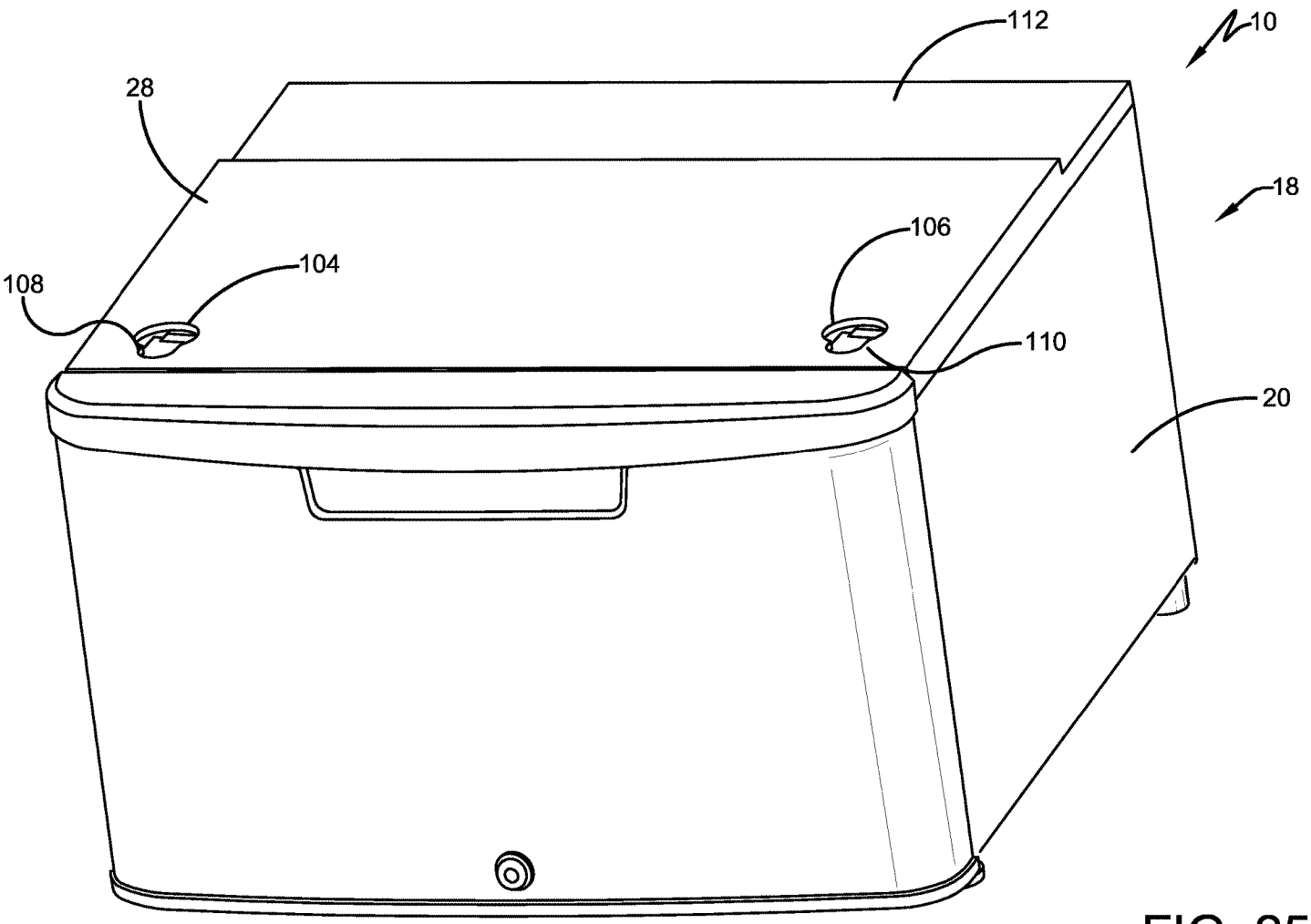
FIG. 25 is a view similar to FIG. 24, with the housing top panel in engaged relation with the housing.

FIGS. 24 and 25 represent the installation of the top panel 28 into engagement with the side wall panels and back wall panel of the housing 18. In the exemplary arrangement, the top panel 28 includes interengaging projections and recesses that engage with the top portions of side wall panels 20 and 22 and back wall panel 26. FIG. 25 shows the top panel 28 in engaged relation with the housing 18 of the exemplary pedestal 10. Of course it should be understood that this configuration is exemplary and in other embodiments, other approaches may be used.

The exemplary top panel 28 includes a pair of disposed foot recesses 104, 106. Foot recesses 104 and 106 are configured to accept a support foot in engagement with the refrigerator 12 therein. The exemplary foot recesses each include a slot 108, 110 that overlies at least a portion of the respective foot recess. In the exemplary arrangement, the slot is configured to have a narrowed portion smaller than the opening of the recess for purposes that are later discussed.

The exemplary top panel 28 further includes a step portion 112. The exemplary step portion 112 has a surface that is somewhat lower in height in the assembled condition of the pedestal than the remainder of the top panel 28.

Figure 26:
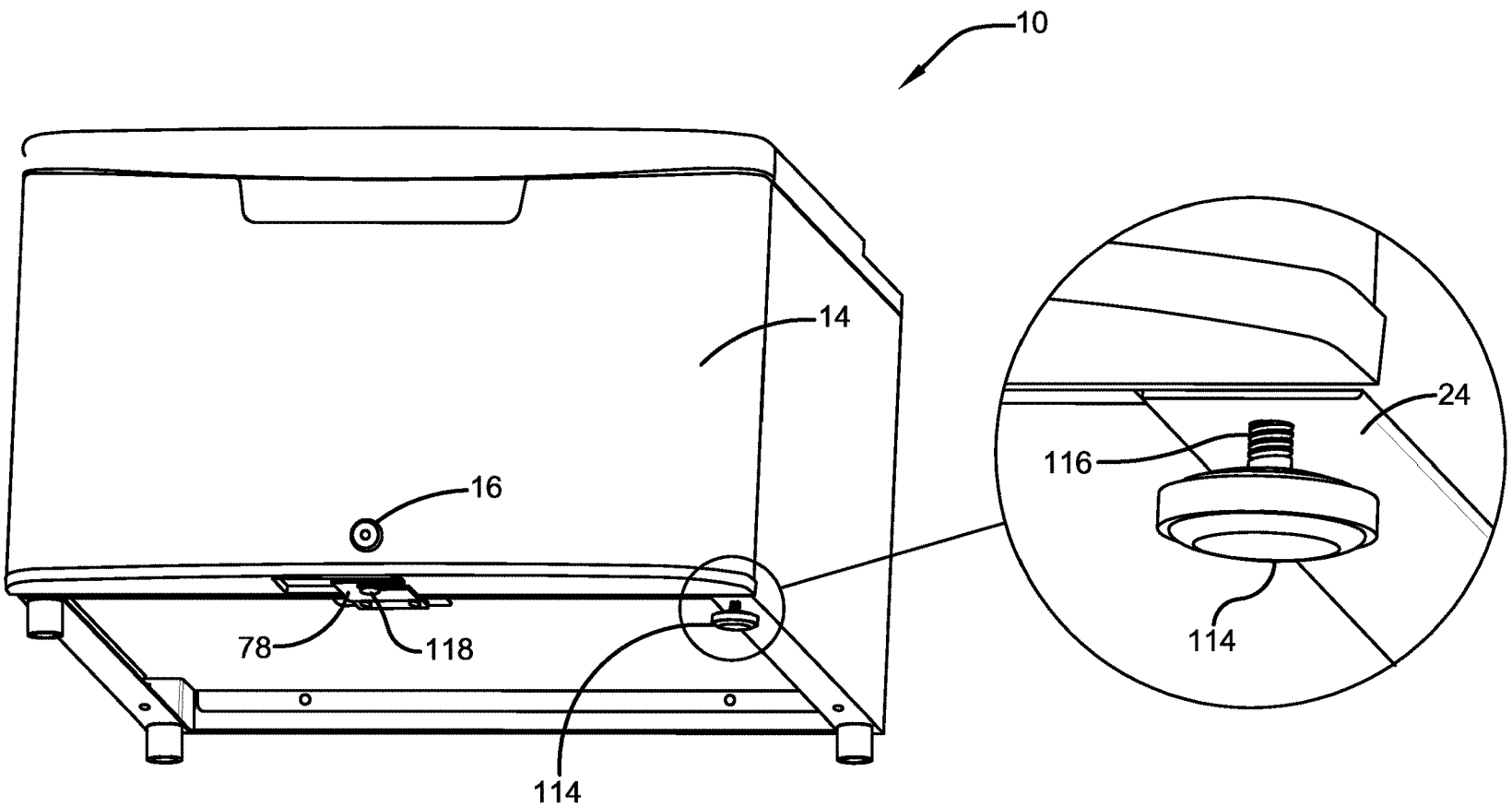
FIG. 26 is a bottom isometric view of the pedestal including an enlarged portion of the height adjustable pedestal support foot.

As shown in FIG. 26, the exemplary pedestal 10 includes at least one height adjustable pedestal support foot 114. While in the embodiment shown only one adjustable pedestal support foot is shown, it should be understood that in exemplary arrangements two or more adjustable pedestal support feet may be utilized. Shown in FIG. 26, the exemplary pedestal foot includes a rotatable threaded stem portion 116. Rotation of the pedestal foot enables adjustment of the distance that the stem portion extends downward from the bottom panel 24. This enables adjusting the height of the pedestal and assuring that the pedestal is enabled to be supported on a floor or other supporting surface that minimizes the extent of movement or rocking thereof.

As further represented in FIG. 26, the latch 16 includes a movable bolt 118. The movable bolt 118 is selectively movable to engage and disengage the strike opening 82 in the strike 78 which is alternatively referred to as a strike plate. In the exemplary arrangement, the latch 16 is operative to hold the door 14 in a closed position by rotating the bolt 118 into engagement with the opening 82 in the strike through the open end thereof. With the bolt in engagement with the strike opening 82, the door is prevented from moving outwardly. To enable the door to be opened, the latch is turned or otherwise manipulated so that the bolt 118 rotates out of the opening 118 in the strike. This enables the door 14 to be moved outwardly from the housing so that the contents of the drawer 32 are accessible to a user.

Figure 27:
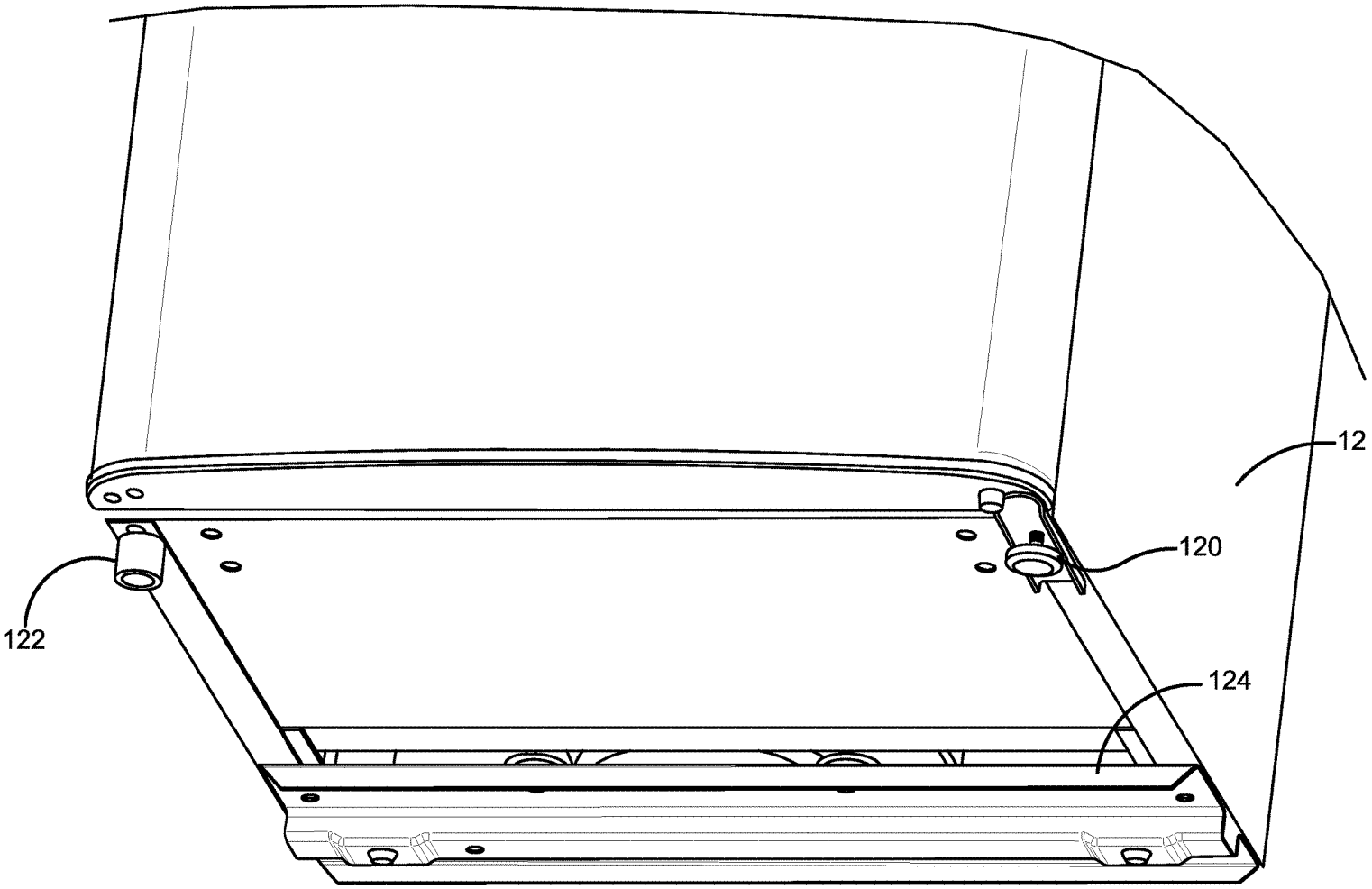
FIG. 27 is a bottom isometric view of the refrigerator showing initial foot structures of the refrigerator.

FIG. 27 shows a bottom view of the exemplary refrigerator 12. The exemplary refrigerator includes feet 120, 122 that extend from the bottom thereof. The bottom of the refrigerator 112 further has a frame portion 124 that extends from the bottom of the refrigerator. In exemplary arrangements, a frame portion 124 is operative to support a compressor or other components within the interior area of the refrigerator.

Figure 28:
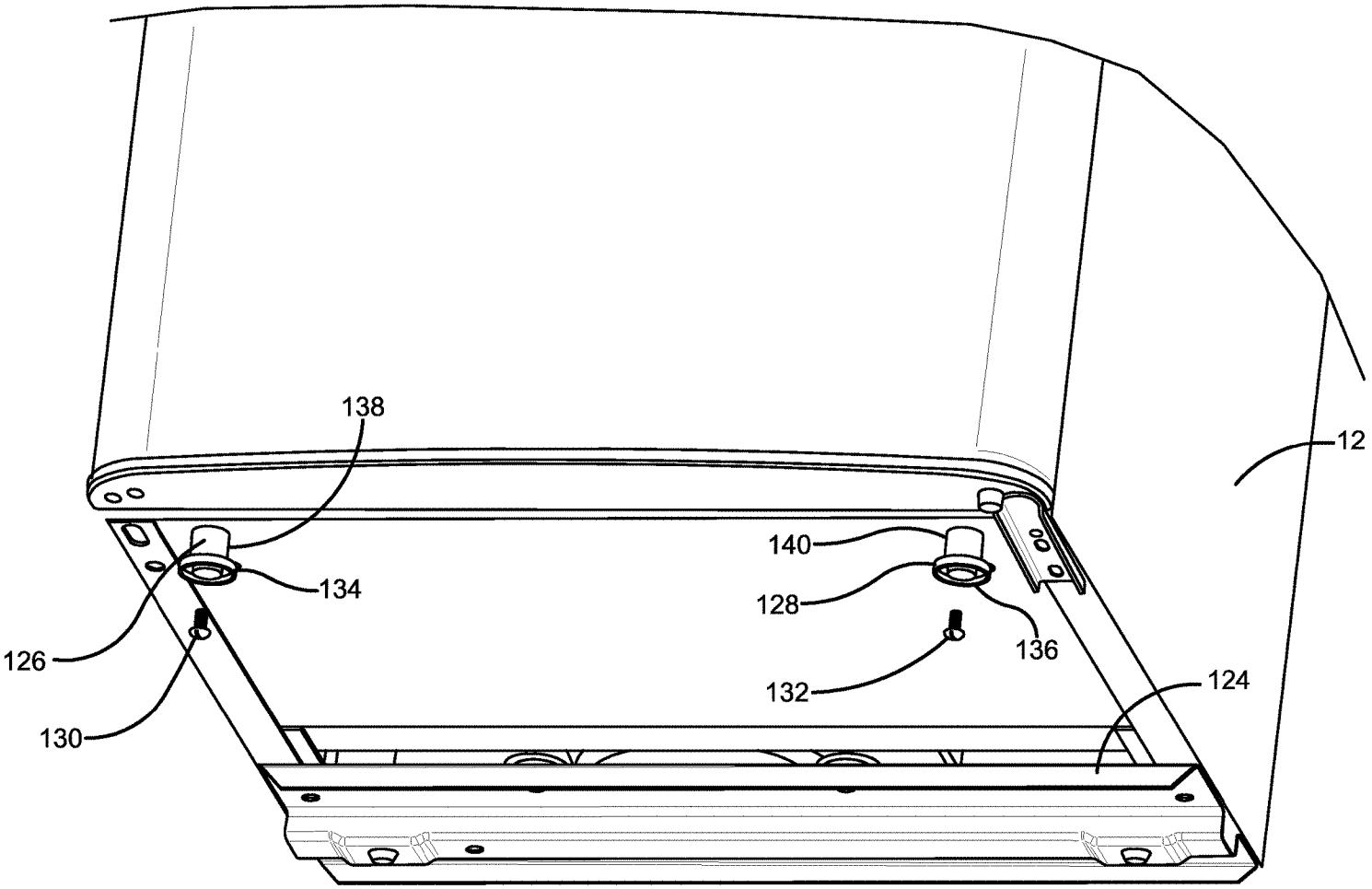
FIG. 28 is a bottom isometric view of the refrigerator showing installation of alternative foot structures in engagement with the refrigerator after the original foot structures are removed.

As represented in FIG. 28 in the exemplary arrangement prior to placing the refrigerator 12 on the exemplary pedestal 10, the original feet 120 and 122 are removed from the bottom of the refrigerator. Replacement feet 126 and 128 are installed and extend from the bottom of the refrigerator in a different location than the original feet. Each foot 126, 128 is attached to the bottom of the refrigerator through fasteners 130, 132 that engage in openings in the bottom of the refrigerator that are inwardly disposed from the openings in which the original feet were positioned.

As shown in FIG. 28, feet 126 and 128 each include a base portion 134, 136. Each base portion is radially enlarged relative to more narrow stem portion 138, 140 which extends between the respective base portion and the bottom of the refrigerator. In the normal vertical position of the refrigerator, the base portion of each foot is radially and horizontally enlarged relative to the stem portion. Of course it should be understood that this configuration is exemplary and in other embodiments, other approaches may be used.

Figure 29:
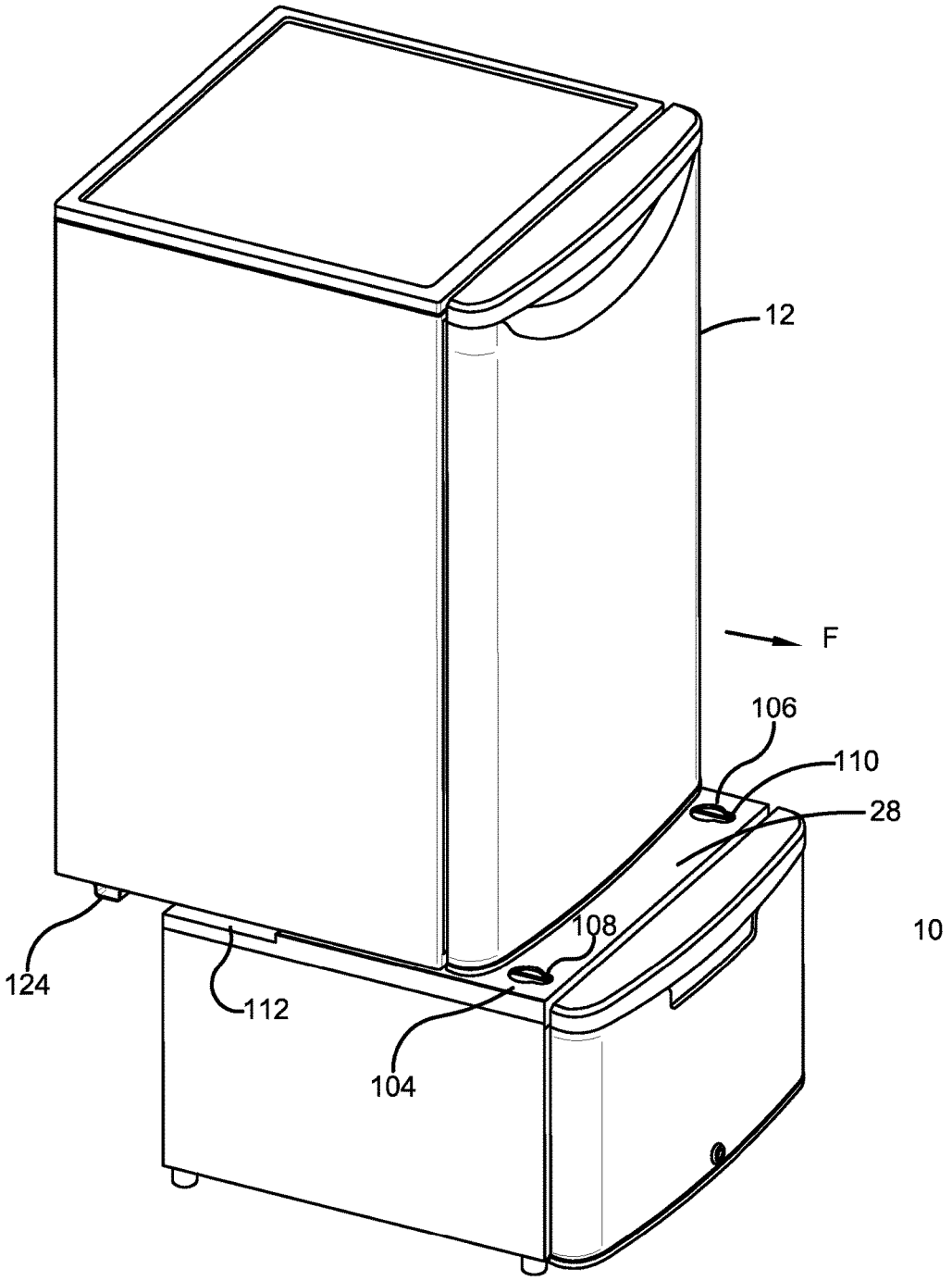
FIG. 29 is a top right isometric view showing the refrigerator and exemplary pedestal being moved into engaged relation.
Figure 30:
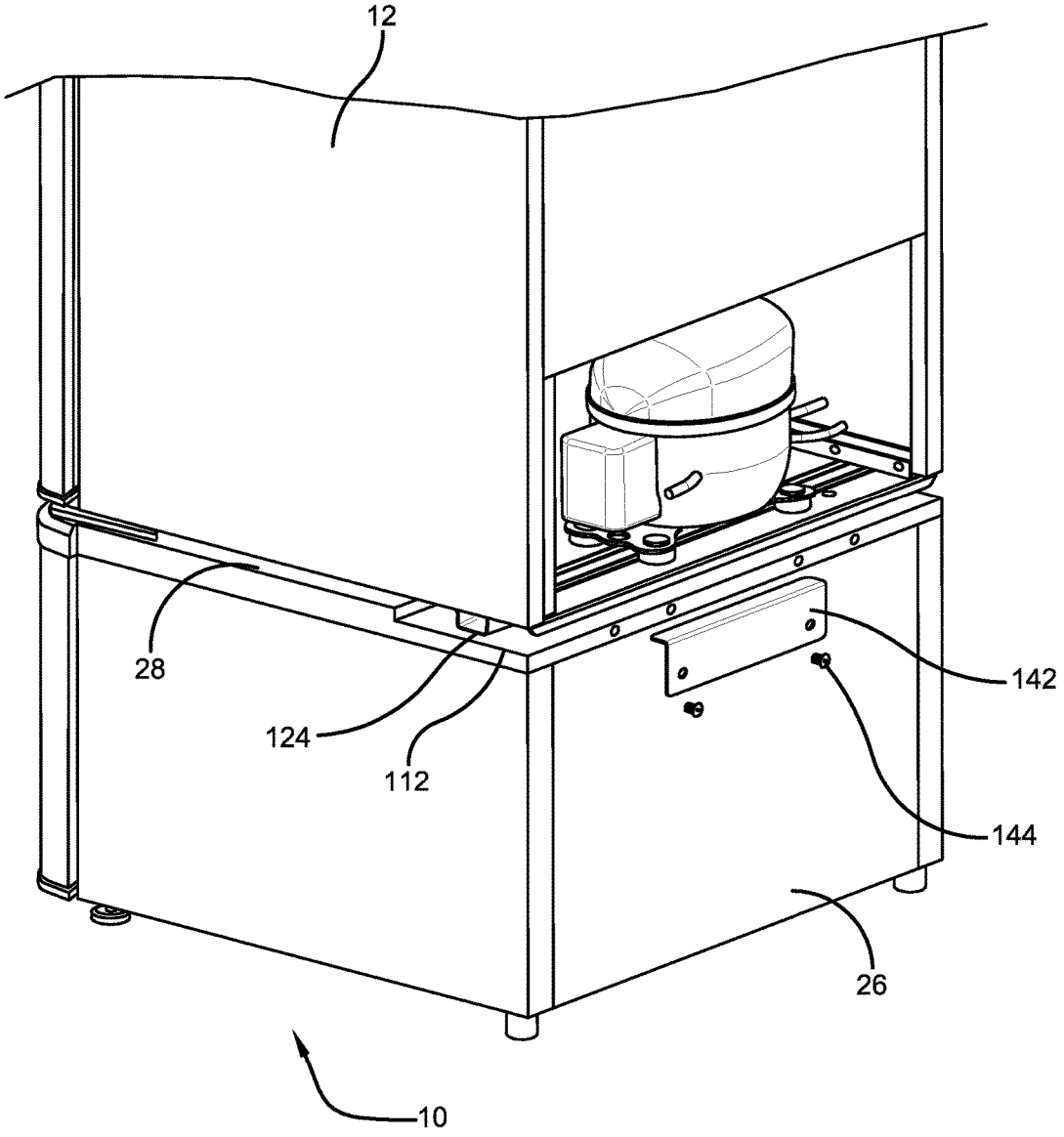
FIG. 30 is a back isometric view of the pedestal and the refrigerator and an exemplary bracket usable to hold the refrigerator and pedestal in fixed engaged relation.
Figure 31:
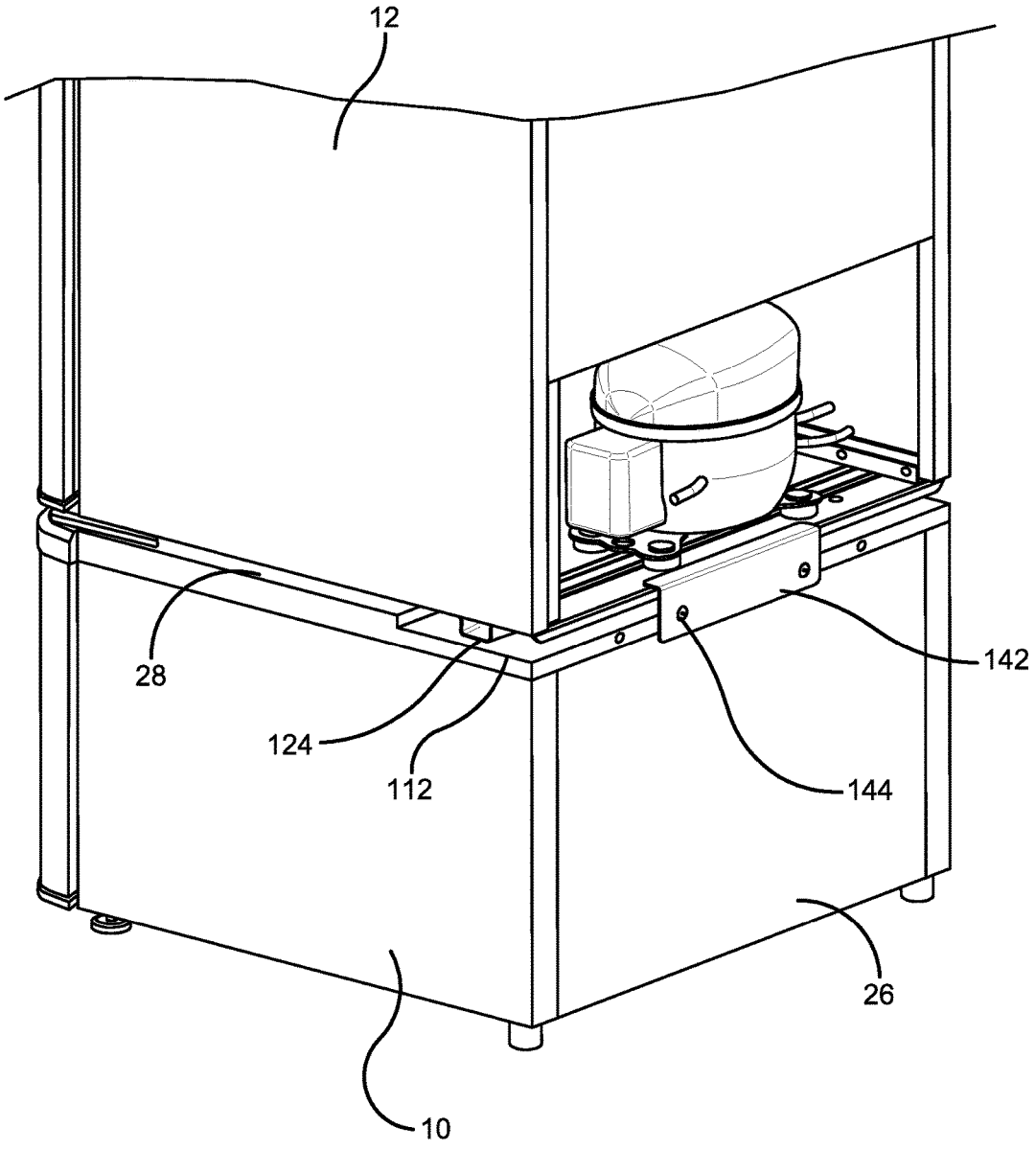
FIG. 31 is a view similar to FIG. 30 showing the bracket in the installed position.

FIGS. 29-31 show the refrigerator 12 being moved into supported engagement with the exemplary pedestal 10. In this exemplary arrangement, the refrigerator is moved horizontally relative to the pedestal in the direction of Arrow F as shown. The exemplary foot recesses 104, 106 are configured to engage the foot portions 126 and 128 therein respectively. Relative horizontal movement of the foot portions within the foot recesses is operative to cause the slots 108, 110 to accept the stem portions 138, 140 therein. With the stem portions moved into engagement with the slots, the enlarged base portion of each foot operates to prevent each foot from disengaging from the top panel 28.

Further as shown in FIGS. 30 and 31, in the exemplary arrangement the frame portion 124 is in operative connection with the step portion 116 of the top panel 28. The exemplary top panel is configured such that when the refrigerator 12 is in supported connection therewith, the step portion and frame cause the refrigerator to be level on the pedestal when the feet 126 and 128 are engaged in the foot recesses. Further in the exemplary arrangement, a bracket 142 is operative to engage the refrigerator and the pedestal. In the exemplary arrangement, bracket 142 is connected to the back wall panel 26 of the housing through fasteners 144. In the exemplary embodiment, the bracket 142 is a generally L-shaped bracket that is operative to engage the frame portion 124 of the refrigerator and to prevent the refrigerator from moving horizontally relative to the pedestal 10. This arrangement is operative to prevent the refrigerator from moving horizontally relative to the pedestal and prevent the feet 126, 128 from disengaging the respective foot recesses 104, 106 in the top panel 28. Thus the exemplary pedestal is in operatively fixed engagement with the refrigerator and prevents the refrigerator from disengaging therefrom due to vibration or other applied forces. Of course it should be understood that this approach to engaging the refrigerator and the pedestal is exemplary and in other embodiments, other approaches may be used.

Thus the elements, features and characteristics of the embodiments described herein achieve desirable results, eliminate difficulties encountered in the use of prior devices and systems, solve problems and attain one or more useful objectives as stated above.

In the foregoing description, certain terms have been used for brevity, clarity and understanding. However, no unnecessary limitations are to be implied therefrom because such terms are used for descriptive purposes and are intended to be broadly construed. Moreover the descriptions and illustrations given herein are by way of examples and the useful features are not limited to the exact details shown and described.

Further the descriptions which refer to "left/right," "top/bottom" or similar terms indicating relative locations of items or features shall not be deemed limiting and it will be understood that exemplary embodiments can be configured and used in numerous different orientations.

Having described the features, discoveries and principles of the exemplary embodiments, the manner in which they are constructed, operated and utilized, and the advantages and useful results attained, the new and useful structures, devices, elements, arrangements, parts, combinations, systems, equipment, operations, methods, processes and relationships are set forth in the appended claims.

I claim:

1. Apparatus comprising:

a pedestal configured to support a refrigerator thereon including a housing comprised of a plurality of assembled panels, the panels including
- a top panel,
- a bottom panel,
- a first side wall panel,
- a second side wall panel,
- a back wall panel, wherein the top and bottom panels are engaged in fixed relation with each of the first, second and back wall panels through interengaging projections and recesses of the panels and held in a fixed relation without the use of fasteners separate from the panels, wherein the top panel includes
- at least two foot recesses, wherein each foot recess is configured to accept therein a respective foot that extends from a bottom of the refrigerator, wherein each foot includes a base portion and a stem portion, wherein the base portion is horizontally larger than the stem portion and in an operative position extends below the stem portion,
- at least two slots, wherein a respective slot overlies a portion of each respective foot recess, wherein each slot is configured to have a respective stem portion extend vertically through the slot,
  - wherein each respective foot recess and overlying slot is configured to enable a respective foot to move horizontally therein such that the respective stem portion of the respective foot can extend through at least a portion of the respective slot while preventing the respective base portion of the foot from passing outwardly from the respective foot recess, and
- a step portion disposed from the foot recesses, wherein the step portion is configured to engage a frame portion that extends downward from the bottom of the refrigerator in the operative position, wherein the step portion is configured to engage the frame portion and cause the refrigerator to generally be level on the housing when each respective foot is engaged in a respective foot recess, a bracket,
- wherein the bracket is configured to extend operatively between the refrigerator and the housing, and prevent horizontal refrigerator movement relative to the top panel such that each base portion of each respective foot in a respective foot recess is prevented from disengagement from the respective foot recess, wherein the plurality of panels are configured such that prior to assembly to form the housing, all of the plurality of panels are packed in flat generally parallel relation in a single box.

2. The apparatus according to claim 1 wherein the housing bounds an interior area, wherein the interior area has an open side generally opposite the back wall panel, and further including a slide out drawer, wherein the slide out drawer is in operative supported connection with the housing in the interior area and is extendable through the open side.

3. The apparatus according to claim 2 wherein the drawer is comprised of a plurality of drawer panels, wherein the drawer panels are held in fixed relation by interengaging projections and recesses of the drawer panels and without use of fasteners separate from the drawer panels, wherein prior to assembly to form the drawer the plurality of drawer panels are packed in flat parallel relation with the plurality of wall panels in the single box.

4. The apparatus according to claim 3 and further comprising:

at least one slide, wherein the plurality of drawer panels includes at least one side drawer panel, at least one pin and at least one slot, wherein each pin includes a shaft portion and an enlarged head portion, and each key slot includes an enlarged key slot end and a narrow key slot end, wherein each enlarged head portion is configured to pass through the enlarged key slot end but not the narrow key slot end and the shaft portion can extend through the narrow key slot end, wherein at least one pin is operatively engaged within one of the at least one slide and the at least one side drawer panel, and the at least one key slot is engaged with the other of the at least one slide and at least one side drawer panel, wherein the at least one slide and the at least one side drawer panel are held in operative engagement by the at least one enlarged head portion being extended through the enlarged key slot end and thereafter relative movement of the at least one slide and the at least one side drawer panel which causes the at least one shaft portion to extend in the at least one narrow key slot end.

5. The apparatus according to claim 4 wherein the at least one pin shaft portion is moved into the at least one key slot narrow end by movement of the at least one side drawer panel perpendicular to the at least one slide.

6. The apparatus according to claim 5 wherein the drawer includes first and second horizontally disposed drawer side panels, wherein each drawer side panel includes at least two key slots, wherein the narrow key slot ends extend upward from the enlarged key slot ends, wherein a first slide includes at least two first pins extending therefrom, wherein a second slide includes at least two second pins extending therefrom, wherein the first pins are engaged in the key slots in the first drawer side panel and the second pins are engaged in the key slots of the second drawer side panel.

7. The apparatus according to claim 6 wherein the first slide includes at least one first further pin, wherein the at least one first further pin extends from the first slide on a side opposed of the at least two first pins, wherein the at least one first further pin is operatively engaged with the first side wall panel.

8. The apparatus according to claim 7 wherein the second slide includes at least one second further pin, wherein the at least one second further pin extends on the second slide on a side opposed of the at least two second pins, wherein the at least one second further pin is operatively engaged with the second side wall panel.

9. The apparatus according to claim 8 wherein the first slide and the second slide are held in fixed operative engagement with the first side wall panel and the second side wall panel respectively without the use of separate fasteners.

10. The apparatus according to claim 9 wherein the plurality of drawer panels further include a drawer back panel, a drawer front panel, and a drawer bottom panel, wherein the drawer bottom panel is in operatively fixed engagement with each of the first drawer side panel, the second drawer side panel, the drawer front panel and the drawer back panel through interengaging projections and recesses of the panels.

11. The apparatus according to claim 10 and further including:

a door panel, wherein the door panel is operatively connected to the front drawer panel and is configured to cover the open side of the housing in a closed position of the drawer.

12. The apparatus according to claim 11 and further comprising:

a strike in operative connection with the bottom panel of the housing, a latch in operative connection with the drawer, wherein the latch includes a movable bolt, wherein the bolt is configured to engage the strike and hold the drawer in the closed position.

13. The apparatus according to claim 12 wherein the door panel is configured prior to assembly to be stacked in flat, parallel relation with the plurality of wall panels and the plurality of drawer panels in the single box.

14. The apparatus according to claim 12 and further comprising:

a strike plate, wherein the strike plate is operatively connected to the bottom panel of the housing, wherein the strike is included in the strike plate, wherein the bolt is rotatable relative to the latch, and is rotatable in a first direction to engage the strike plate, and is rotatable in a second direction opposed of the first direction to disengage the strike plate.

15. The apparatus according to claim 14 and further comprising:

at least one height adjustable pedestal support foot, wherein the pedestal support foot is in operative connection with the bottom panel and extends below the bottom panel.

16. The apparatus according to claim 15 wherein the single box includes the at least two feet engageable with the foot recesses, wherein each of the feet are configured to replace an existing refrigerator support foot that is included on the refrigerator prior to engagement with the pedestal.

17. Apparatus comprising:

a pedestal configured to support a refrigerator thereon including a housing comprised of a plurality of assembled housing panels, the housing panels including a top panel, a bottom panel, a first side wall panel, a second side wall panel, a back wall panel, wherein the top and bottom housing panels are engaged in fixed relation with each of the first, second and back wall housing panels through interengaging projections and recesses of the housing panels and held in fixed relation without the use of fasteners separate from the housing panels, wherein the housing bounds an interior area, wherein the interior area has an open side generally opposite the back wall panel, a drawer, wherein the drawer is comprised of a plurality of drawer panels, wherein the drawer panels are engaged in fixed relation by interengaging projections and recesses of the drawer panels and without use of fasteners separate from the drawer panels, at least one slide, wherein the at least one slide includes a plurality of pins, wherein each of the pins extends outward in a first direction from the slide, a plurality of further pins, wherein each of the further pins extends outward from the slide in a second direction from the slide, wherein the second direction is opposed of the first direction, wherein each of the pins and further pins include a respective shaft portion and a head portion, wherein the head portion is radially enlarged relative to the shaft portion and extends at an outward end of the shaft portion, wherein at least one housing panel includes at least one housing panel key slot, wherein at least one drawer panel includes at least one drawer panel key slot, wherein each of the housing panel key slots and drawer panel key slots include an enlarged key slot end and a narrow key slot end, wherein each enlarged head portion of each of the pins and further pins is configured to pass through a respective enlarged key slot end of a respective housing panel key slot or drawer panel key slot, but not the narrow key slot end of the respective key slot, and the shaft portion can extend through the narrow key slot end of the respective key slot, whereby the respective key slot is engageable with a respective pin or further pin by extending the enlarged head through the enlarged key slot end, and then relatively moving the key slot and pin or further pin such that the shaft portion extends in the respective narrow key slot end, wherein the drawer is engaged in movable connection with the housing without separate fasteners by the plurality of pins engaged in respective housing panel key slots and the plurality of further pins engaged in respective drawer panel key slots.

18. The apparatus according to claim 17 wherein the top panel includes at least two foot recesses, wherein each foot recess is configured to accept a foot that extends from a bottom of the refrigerator.

19. The apparatus according to claim 18 wherein each foot includes a stem portion and a base portion, wherein the base portion is horizontally larger than the stem portion and in an operative position extends below the stem portion, wherein the top panel includes respective slots, wherein each respective slot overlies a portion of each respective foot recess, wherein each slot is configured to have a stem portion extending through the slot while preventing the base portion from passing outwardly from the respective foot recess.

20. The apparatus according to claim 19 wherein each foot recess is configured to enable a respective foot to move horizontally therein, such that the respective stem portion of the foot can extend vertically through at least a portion of the respective slot.

21. The apparatus according to claim 20 and further including a bracket, wherein the bracket is configured to extend operatively between the refrigerator and the housing, wherein the bracket is configured to prevent the refrigerator from being moved horizontally relative to the top panel such that each base portion of each respective foot is prevented from disengaging the respective foot recess by the respective engagement of the stem portion and the slot.

22. The apparatus according to claim 17 and further including one box, wherein prior to assembly, all of the housing panels and all of the drawer panels are packed in generally parallel relation in the box.

23. Apparatus comprising:

a pedestal configured to support a refrigerator thereon including a housing comprised of a plurality of assembled panels, the panels including a top panel, a bottom panel, a first side wall panel, a second side wall panel, a back wall panel, wherein the top and bottom panels are engaged in fixed relation with each of the first, second and back wall panels through interengaging projections and recesses of the panels and held in fixed relation without the use of fasteners separate from the panels, wherein the top panel includes at least two foot recesses, wherein each foot recess is configured to accept therein a respective foot that extends from a bottom of the refrigerator, wherein each foot includes a base portion and a stem portion, wherein the base portion is horizontally larger than the stem portion and in an operative position extends below the stem portion, at least two slots, wherein a respective slot overlies a portion of each respective foot recess, wherein each slot is configured to enable a respective stem portion to extend vertically through the slot, wherein each respective foot recess and overlying slot is configured to enable a respective foot to move vertically inwardly into the respective foot recess and then to move horizontally relative to the top panel in the respective foot recess and slot in a first direction to an engaged position, such that in the engaged position the respective stem portion of the foot extends through at least a portion of the respective slot while the respective base portion of the foot extends below the slot and is prevented from passing vertically outwardly from the respective foot recess, a bracket, wherein the bracket is configured to extend operatively between the refrigerator and the housing, and to prevent movement of each respective foot horizontally relative to the top panel in the respective foot recess in a second direction opposed of the first direction such that each base portion of each respective foot in a respective foot recess is prevented from moving from the engaged position, whereby the refrigerator and the housing are held in engaged relation.

24. Apparatus comprising:

a pedestal configured to support a refrigerator thereon including a housing comprised of a plurality of assembled housing panels, the housing panels including a top panel, a bottom panel, a first side wall panel, a second side wall panel, a back wall panel, wherein the top and bottom housing panels are engaged in fixed relation with each of the first, second and back wall housing panels through interengaging projections and recesses of the housing panels and held in fixed relation without the use of fasteners separate from the interengaging projections and recesses of the housing panels, wherein the housing bounds an interior area, wherein the interior area has an open side generally opposite the back wall panel, and further including a drawer, wherein the drawer is comprised of a plurality of drawer panels, wherein the drawer panels are engaged in fixed relation by interengaging projections and recesses of the drawer panels and without use of fasteners separate from the projections and recesses of the drawer panels, at least one slide, wherein each at least one slide includes a plurality of slide projections, wherein each of the slide projections extends outward in a first direction from the slide, a plurality of further slide projections, wherein each of the further slide projections extends outward from the slide in a second direction from the slide, wherein the second direction is opposed of the first direction, wherein at least one housing panel includes at least one housing panel opening wherein the at least one housing panel opening includes a received slide projection therein in engaged relation, wherein at least one drawer panel includes at least one drawer panel opening, wherein the at least one drawer panel opening includes a received further slide projection therein in engaged relation, wherein at least some of the slide projections and/or at least some of the further slide projections comprise pins that each include a respective shaft portion and a respective head portion, wherein the head portion is radially enlarged relative to the shaft portion, wherein at least some of the housing panel openings and/or at least some of the slide panel openings that have respective pins received therein include a key slot, wherein each key slot includes an enlarged key slot end and a narrow key slot end, wherein each enlarged head portion of each pin is configured to pass through the enlarged key slot end of a respective engaged key slot but not the narrow key slot end of the respective key slot, but the shaft portion of the respective pin is extendable through the narrow key slot end of the respective engaging key slot, whereby the respective key slot is engaged with the respective pin received therein by the enlarged head of the respective pin being extended through the enlarged key slot end of the respective key slot, and then the pin and key slot being relatively moved such that the shaft portion extends in the respective narrow key slot end, wherein the drawer is engaged in movable operatively supported connection with the housing through the at least one slide without separate fasteners by the plurality of slide projections engaged in respective housing panel openings and the plurality of further slide projections engaged in respective drawer panel openings, such that the drawer is movably extendable through the open side of the housing.

* * * * *